US005963225A

United States Patent [19]

Sugiyama

[11] Patent Number: 5,963,225

[45] Date of Patent: Oct. 5, 1999

[54] RECORDING APPARATUS AND METHOD OF DETECTING MALFUNCTION OF INK DETECTION MEANS

[75] Inventor: Shigeyuki Sugiyama, Hiratsuka, Japan

[73] Assignee: Canon Kabushiki Kaisha, Tokyo, Japan

[21] Appl. No.: 08/654,972

[22] Filed: May 28, 1996

[30] Foreign Application Priority Data

| | | | |
|---|---|---|---|
| May 29, 1995 | [JP] | Japan | 7-130602 |
| Mar. 6, 1996 | [JP] | Japan | 8-048870 |
| Mar. 6, 1996 | [JP] | Japan | 8-049189 |
| Apr. 26, 1996 | [JP] | Japan | 8-107692 |

[51] Int. Cl.[6] ..... B41J 2/01

[52] U.S. Cl. ..... 347/19; 347/7; 347/14; 250/573; 250/214 R

[58] Field of Search ..... 347/19, 7, 14; 250/559.1, 573, 576, 577, 214 R

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,381,455 | 4/1983 | Komori | 250/554 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,132,711 | 7/1992 | Shinada et al. | 346/140 R |
| 5,434,430 | 7/1995 | Stewart | 250/573 |
| 5,508,722 | 4/1996 | Saito et al. | 347/17 |
| 5,638,097 | 6/1997 | Takayanagi et al. | 347/7 |

FOREIGN PATENT DOCUMENTS

| | | | |
|---|---|---|---|
| 0443832 | 8/1991 | European Pat. Off. | H04N 1/034 |
| 54-056847 | 5/1979 | Japan . | |
| 56-144185 | 11/1981 | Japan | B41J 27/00 |
| 59-123670 | 7/1984 | Japan . | |
| 60-071260 | 4/1985 | Japan . | |

OTHER PUBLICATIONS

"Optical Scanner Maintenance and Initialization," IBM Technical Disclosure Bulletin, vol. 19, No. 1, pp. 254–255, Jun. 1976.

"Online Optical Sensor Malfunction Detection," IBM Technical Disclosure Bulletin, vol. 26, No. 3B, pp. 1726–1727, Aug. 1983.

*Primary Examiner*—Valerie Lund
*Assistant Examiner*—Christina Annick
*Attorney, Agent, or Firm*—Fitzpatrick, Cella, Harper & Scinto

[57] ABSTRACT

A recording apparatus capable of determining malfunction of an ink detection device such that a light emitting device of an ink detection sensor provided for the recording apparatus to detect ink depending upon whether ink traversing a detection optical axis exists is periodically operated to emit light. Malfunction of the ink detection sensor is determined in accordance with the quantity of light received by a light receiving device in a state where ink traversing the detection optical axis is not discharged.

29 Claims, 20 Drawing Sheets

| FIG. 8A | FIG. 8B |
|---|---|

START

S101
CARTRIDGE CHANGED ?
NO
YES
TURN SENSOR ON
S102
WAIT FOR 410 msec
S103
OPEN window
S104
STORE OUTPUT VALUE FROM SENSOR
S105
CLOSE window
S106
TURN SENSOR OFF
S107
READ STORED OUTPUT VALUE
S108
S109
LIGHT-INTERRUPTING OBJECT EXISTS ?
NO
YES
DISPLAY "SENSOR DEFECTIVE"
S110

| FIG. 9A |
| --- |
| FIG. 9B |

| FIG. 10A |
| --- |
| FIG. 10B |

START
TURN TIMER ON
S301
PRINTING COMMAND FROM CPU ?
S302
NO
YES
RECORD ONE SHEET
S303
TURN SENSOR ON
S304
WAIT FOR 410 msec
S305
OPEN window
S306
DISCHARGE FOR DETECTING RESIDUAL QUANTITY OF INK
S307
STORE OUTPUT VALUE FROM SENSOR
S308
CLOSE window
S309
TURN SENSOR OFF
S310
READ STORED OUTPUT VALUE
S311
INK EXISTS ?
S312
NO
YES
RECORDING COMPLETED ?
S313
NO
YES
STORE IMAGE DATA IN MEMORY
S314
DISPLAY "NO INK"
S315

| FIG. 11A | FIG. 11B |
|---|---|

RECORDING APPARATUS AND METHOD OF DETECTING MALFUNCTION OF INK DETECTION MEANS

BACKGROUND OF THE INVENTION

1. Field of the Invention

The present invention relates to a recording apparatus and a method of detecting a malfunction of an ink detection means, and more particularly to an ink jet recording apparatus in a facsimile apparatus, a printer or a copying machine having means for detecting a residual quantity of ink mounted thereon and a method of detecting a malfunction of the means for detecting the residual quantity of ink.

2. Related Background Art

Hitherto, a variety of recording apparatuses arranged to record information on a recording medium, such as paper or an OHP sheet, have been suggested. An ink jet recording apparatus directly jetting ink from a recording head to the recording sheet has been used as a recording apparatus having a low running cost and silent recording operation.

As a method of detecting a residual quantity of ink for a conventional ink jet recording apparatus, a method has been employed in which a mark for detecting whether or not ink exists is recorded on a recording medium so as to be detected by a reflection-type photosensor. If the mark is not detected by the photosensor, a determination is performed that the ink has been consumed. As an alternative to this, ink is discharged to a position between a light emitting device and a light receiving device of a photointerrupter so as to detect existence of ink in accordance with a change in the output when the ink traverses the optical axis. If no ink is detected, a determination is performed that the ink has been consumed.

Although in the foregoing method for detecting whether or not ink exists it is required to record a mark on the recording medium which is not required for the recording operation, a satisfactory detection accuracy can be realized. However, foreign matter in the air can adhere to the reflecting type photosensor, causing an error in ink detection.

In the method of detecting whether ink exists in accordance with the change in the output when ink traverses the optical axis, it is required for the ink to optically shield the optical axis. To achieve this, a slit formed between the light emitting device and the light receiving device must have a small width because the ink droplet is very small. However, a slit having such a small width can sometimes be filled with fine mists of ink generated in a large quantity when ink is discharged or ink which comes in contact with the recording medium may afterward adhere to the slit. In the foregoing cases, detection cannot be performed. Moreover, so-called house dust is sometimes allowed to adhere to the slit and deposit on the slit portion, thus causing an error to take place in detection.

In a case where ink of a type having high viscosity is used, ink allowed to pass through the optical axis of the photointerrupter and received by the ink receiver is deposited and overlapped, thus resulting in a deposit like a stalactite being formed. If the deposit is enlarged so that its height from the receiving surface of the ink receiver reaches the optical axis, the optical axis of the photointerrupter can be shielded. If the foregoing state is realized, the optical axis is always shielded and, therefore, existence of ink cannot be detected.

SUMMARY OF THE INVENTION

In view of the foregoing, an object of the present invention is to provide a recording apparatus and a method for detecting a malfunction of an ink detection means.

According to one aspect of the present invention, there is provided a recording apparatus having a recording head for discharging ink to record data on a recording medium, the recording apparatus comprising: ink detection means for detecting ink discharged from the recording head; control means for controlling the ink detection means to operate the ink detection means when ink is not discharged from the recording head; and determination means for determining that a malfunction of the ink detection means has occurred where an output from the ink detection means indicates ink being discharged from the recording head when the control means has operated the ink detection means while ink is not discharged from the recording head.

According to another aspect of the present invention, there is provided a method of detecting a malfunction of an ink detection means for detecting ink discharged from a recording head for performing recording by discharging ink, the method comprising the steps of: operating the ink detection means when ink is not discharged from the recording means; and determining that operation of the ink detection means is defective when an output from the ink detection means indicates that ink has been discharged from the recording head.

As a result of the foregoing structure, a malfunction of the ink detection means can be determined by the recording apparatus. Therefore, erroneous detection due to malfunction of the ink detection means can be prevented.

Other objects, features and advantages of the invention will be evident from the following detailed description of the preferred embodiments described in conjunction with the attached drawings.

DESCRIPTION OF THE PREFERRED EMBODIMENTS

Figure 1:
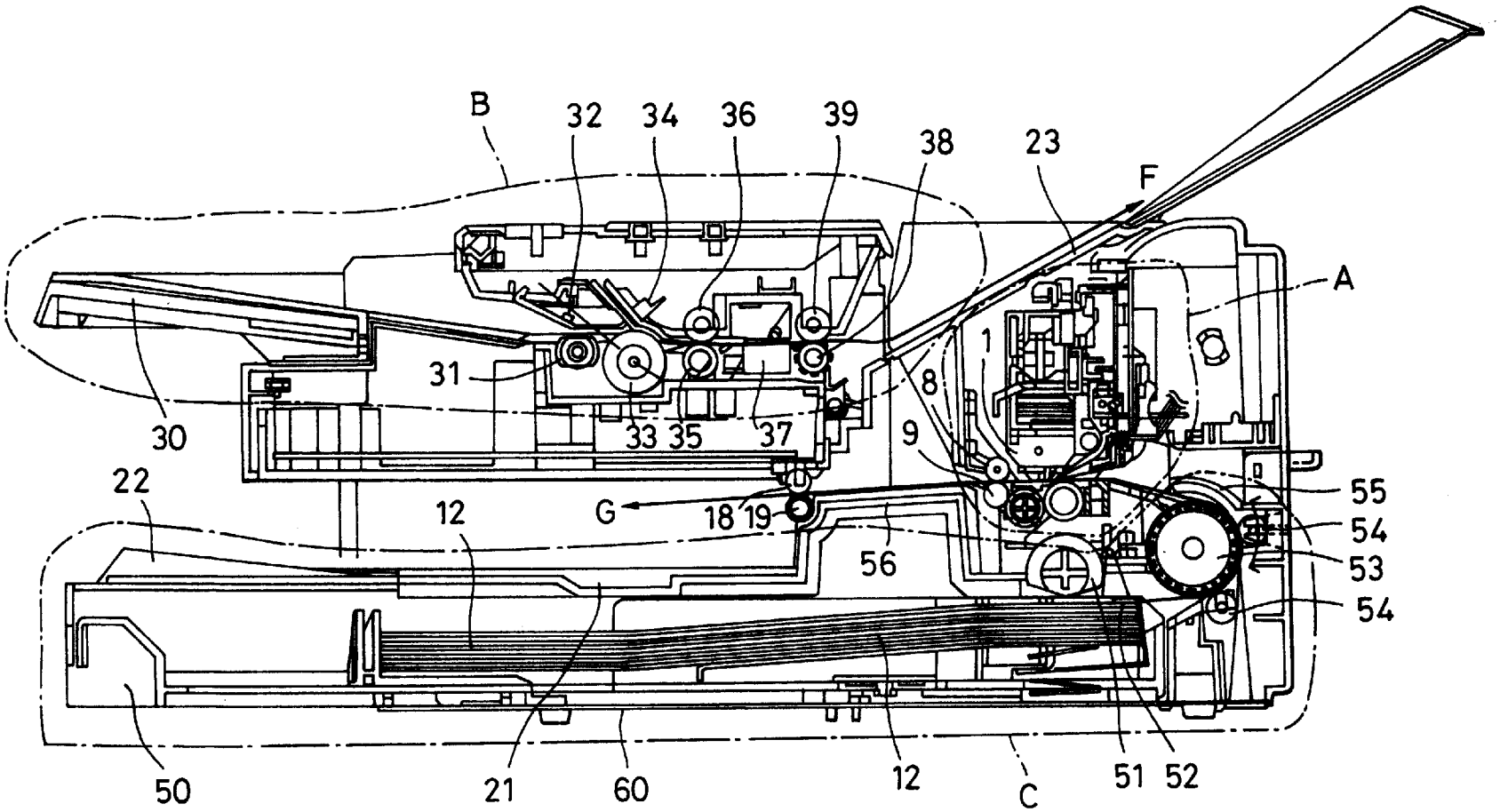
FIG. 1 is a cross sectional view of a facsimile apparatus to which the present invention is applied.

Referring to the drawings, preferred embodiments of the present invention will now be described in detail.

FIG. 1 is a cross sectional view showing a facsimile apparatus to which the recording apparatus according to the present invention is adapted. Symbol A represents a recording unit, which is an ink jet recording apparatus; B represents a reading unit for optically reading an original document; and C represents a paper feeding unit for separating recording sheets stacked in a recording paper cassette so as to supply a recording sheet to the recording unit A.

Referring to FIG. 1, the flow of a recording medium (hereinafter called a "recording sheet") will schematically be described. A sequential passage for the recording sheet is indicated by an arrow G. In this embodiment, cut sheets having a standard size are employed such that the cut sheets are accommodated in a recording-paper cassette 50. The recording-paper cassette 50 is detachable with respect to a body 60, the recording-paper cassette 50 according to this embodiment being formed into a so-called universal cassette capable of accommodating standard recording sheets having various sizes.

Recording sheets 12 accommodated and stacked in the recording-paper cassette 50 are sequentially picked up by a paper feeding roller 51 and a separation claw 52, and then held between a conveying roller 53 and a roller 54, disposed to oppose the conveying roller 53, so as to be conveyed. Reference numeral 55 represents an inversion guide for turning over and inverting the recording sheet 12 in the form of a U-shape.

In the recording unit A, there are disposed a discharge roller 9 disposed downstream of the recording head 1 so as to convey the recording sheet 12 recorded by the recording head 1 downstream of the apparatus; and a wheel 8 disposed to oppose the discharge roller 9 and made of material to which ink cannot be transferred even if the wheel 8 comes in contact with the printing surface of the recording sheet 12. Reference numeral 56 represents a rear guide having a plurality of ribs so as to form a conveyance passage for controlling the lower portion of the recording sheet 12 printed by the recording head 1 and to be discharged.

Reference numeral 18 represents a wheel made of the same material as that of the wheel 8, the wheel 18 being arranged, together with a discharge roller 19, to discharge and stack the recorded recording sheet 12 onto a cassette cover 22. The cassette cover 22 also serves as a discharge rib 21 and a discharge tray provided for the body 60.

Reference numeral 23 represents a cover which may be opened and closed and arranged to open a space required to change the recording head 1 when the cover 23 is opened; the cover 23 also opens a space above a rear guide 56.

The flow of a sheet member (hereinafter called an "original document") will now be described. When one or more original document sheets are set on an original document tray 30, an original document detection sensor (not shown) detects the existence of the original document. When a start button (not shown) is depressed by a user when the user intends to perform facsimile transmission or copying operation, a stepping motor (not shown), which is a drive force source, rotates a previous conveying roller 31 so that the original document is held between the previous conveying roller 31 and a previous conveying pressing plate 32. Thus, the leading ends of the original document are separated as desired.

Then, the original document is conveyed to a separation section consisting of a separation roller 33, arranged to be rotated by the stepping motor, and a frictional-member unit 34 so that the original document sheets are sequentially separated if the original document consists of a plurality of pages. Then, the separated original document sheet is held and conveyed by a paper supply roller 35, arranged to be rotated by the stepping motor, and a paper supply roller 36 disposed to oppose the paper supply roller 35. Then, the leading end of the original document sheet is detected by a sensor (not shown) for detecting the leading and trailing ends of an original document.

The sensor for detecting the leading and trailing ends of an original document detects the trailing end of the original document while causing a contact sensor 37, which is a device for reading an original document, to read image data of the original document. The discharge roller 38, arranged to be rotated by the stepping motor, is rotated by a predetermined amount in accordance with an output from the sensor for detecting the leading and trailing ends of an original document. Thus, the original document is held and conveyed by the discharge roller 39 disposed to oppose the discharge roller 38, and is then stacked on the cover 23 which also serves as the original document discharge tray, following a path indicated by arrow F.

Figure 2:
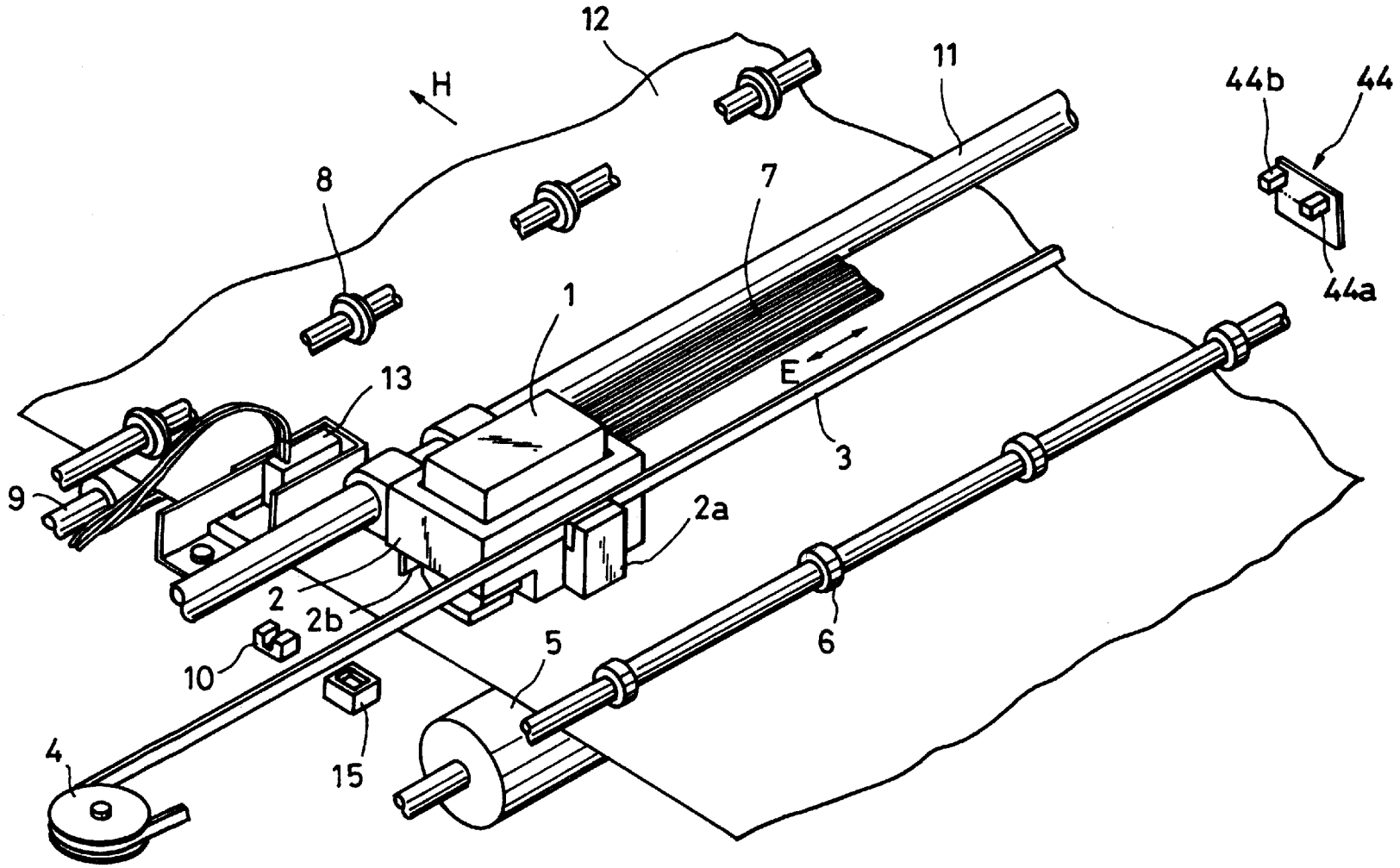
FIG. 2 is a schematic perspective view of the structure of an ink jet recording section.

The structure of the recording unit A of the facsimile apparatus according to this embodiment will now be described in detail with reference to FIG. 2. Referring to FIG. 2, reference numeral 1 represents a recording head which is, in this embodiment, formed into a head cartridge including an ink tank and permitting the ink jet recording head to be changed after ink has been consumed. Note that the recording head 1 may be formed into a structure permitting an ink tank to be separated after ink has been consumed. Reference numeral 2 represents a carriage for accurately holding the recording sheet 12 together with the recording head 1 and arranged to reciprocate in a direction perpendicular to a direction H (a sub-scanning direction) in which the recording sheet 12 is conveyed, that is, in a main scanning direction E. The carriage 2 is slidably held by a guide rod 11 and an abutting section 2*a*. The reciprocating operation of the carriage 2 is performed by a pulley 4 and a timing belt 3 which are rotated by a motor (not shown). At this time, a printing signal and electric power to be supplied to the recording head 1 are supplied from an electric circuit in the body of the apparatus through a flexible cable 7.

Reference numeral 15 represents a cap serving as an ink receiving means and disposed to correspond to a position (home position) at which the carriage 2 stands by. When required, the cap 15 is moved vertically so as to be brought into hermetic contact with the ink discharge surface of the recording head 1; the cap 15 is thus moved upwards so as to cover the nozzle section in order to prevent evaporation of ink and adhesion of dust.

In this embodiment, the recording head 1 and the cap 15 are positioned to oppose each other by using a carriage home sensor 10 provided in the body of the apparatus and a light-shield plate 2*b* provided on the carriage 2. The carriage home sensor 10 comprises a transmission-type photointerrupter. When the carriage 2 has been moved to the standby position, light emitted from a portion of the carriage home sensor 10 is interrupted by the light-shield plate 2*b*. The foregoing fact is used to detect that the recording head 1 and the cap 15 are positioned to oppose each other.

The recording sheet 12 is supplied from the right (as viewed in FIG. 2) and conveyed in a direction (the sub-scanning direction) indicated by an arrow H by a conveying roller 5 and a pressing roller 6, the pressing roller 6 being disposed to face the conveying roller 5 and separated therefrom by a predetermined distance by a bearing member (not shown). The conveying roller 5 and the discharge roller 9 respectively are rotated by drive systems (not shown) so as to accurately convey the recording sheet 12 in the sub-scanning direction in synchronization with the reciprocating operation of the carriage 2 if necessary. Reference numeral 8 represents a member called a "wheel" made of water-repellent material and arranged to be brought into contact with the recording surface of the recording sheet 12 in only the circumferential portion thereof. The wheel 8 is disposed to be separated from the discharge roller 9 by a predetermined distance by a bearing member (not shown), so as to be capable of guiding and conveying the recording sheet 12 without disturbing the recorded image even if the wheel 8 comes in contact with non-fixed ink on the recording sheet immediately after the image has been printed. Reference numeral 13 represents a photosensor capable of detecting jamming of the recording sheet.

The recording head 1 according to this embodiment discharges ink through the discharge ports at the leading end of the nozzle due to pressure from boiling of a film generated in the ink due to heat generated by electricity-to-heat conversion elements disposed in the nozzle. The facsimile apparatus according to this embodiment may use as the recording head 1 a monochrome recording head having 28 nozzles and a resolution of 360 DPI and arranged to record a black image, and a color recording head formed by integrating yellow, magenta and cyan ink tanks each having 24 nozzles and a resolution of 360 DPI. By separably using the two types of the recording heads, high-speed monochrome printing and precise full color printing can be performed.

A principle of ink discharge for the recording head for use in the ink jet recording apparatus according to this embodiment as the recording means of the present invention will now be described. A recording head portion adapted to an ink jet recording apparatus generally comprises fine liquid discharge ports (orifices), a liquid passage, an energy effecting portion formed in a portion of the liquid passage, and an energy generating means for generating ink discharge energy to be effected on the ink, which exists in the energy effecting portion. The recording head is arranged to be changeable.

The energy generating means for generating the energy is exemplified by an electromechanical converter, such as a piezoelectric device, a device for emitting electromagnetic waves, such as laser beams, so as to be absorbed by liquid positioned at the subject position to generate heat with which a liquid droplet is discharged and caused to fly, or a device having a structure such that electricity-to-heat converter heats a liquid to discharge the liquid. Among the foregoing devices, the recording head portion for use in the ink jet recording apparatus for discharging liquid by heat energy enables liquid droplets to be formed in the liquid discharge ports (orifices) and discharges flying liquid droplets to be disposed densely on the recording sheet; thus, high-resolution recording may be performed.

The size of the recording head portion comprising the electricity-to-heat converter as the energy generating means can be reduced. Moreover, the advantages of IC technology and microprocessor technology, which have been progressed significantly in recent years with satisfactory reliability can be used, thus enabling a long and planar (2D shape) structure to be formed easily. Thus, a multi-nozzle structure and a high density mounting may be formed. Moreover, an ink jet recording head portion can be provided which permits mass production with a satisfactory manufacturing yield and a low cost.

The ink jet recording head portion comprising the electricity-to-heat converter as the energy generating means and manufactured by a semiconductor manufacturing process generally has liquid passages corresponding to the respective ink discharge ports and electricity-to-heat converters serving as a means for causing heat energy to act on liquid enclosed in the liquid passages so as to discharge liquid through corresponding ink discharge ports, wherein each liquid passage is supplied with liquid from a common liquid chamber which communicates with each liquid passage.

Figure 3:
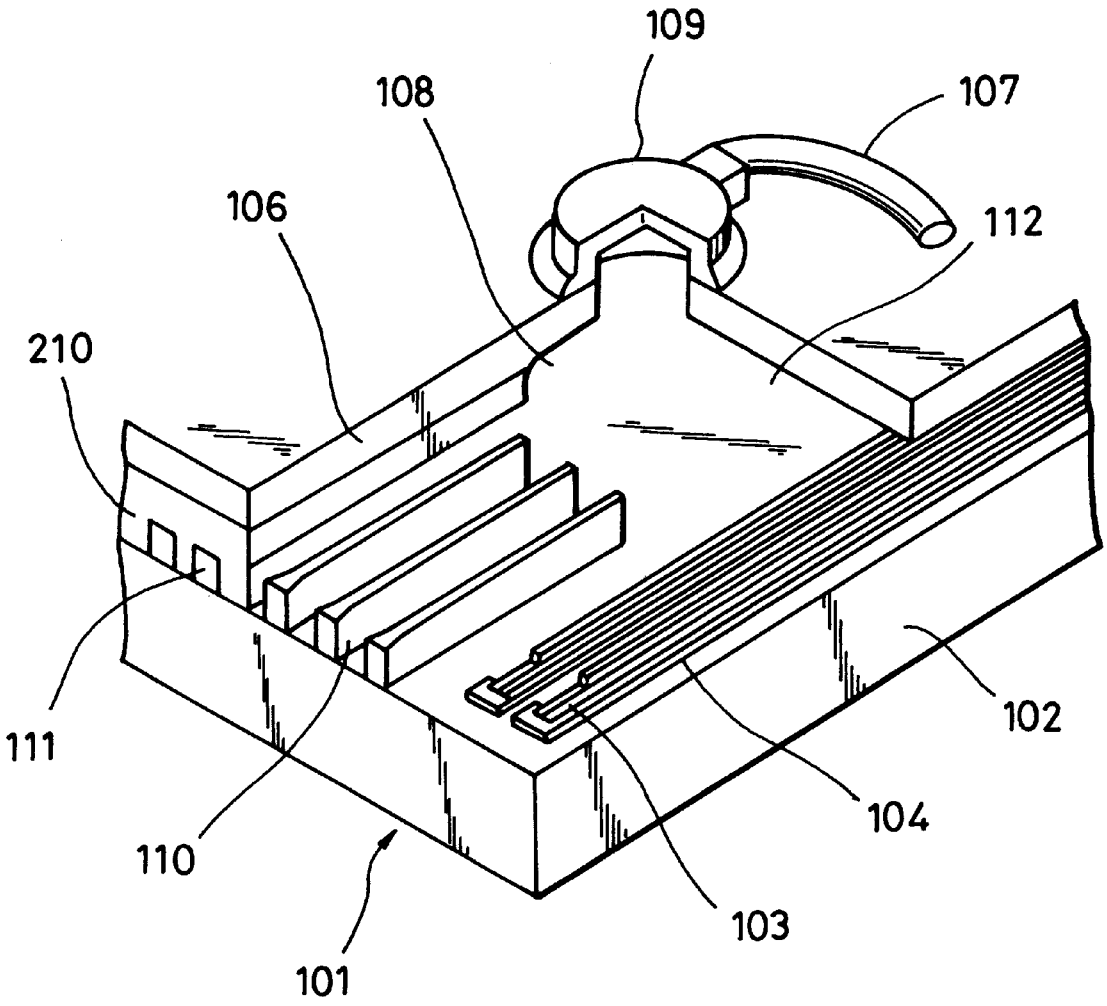
FIG. 3 is a perspective view of the structure of a recording head.

FIG. 3 shows the schematic structure of the foregoing ink jet recording head portion. As a result of a semiconductor manufacturing process including etching, evaporation and sputtering, a recording head portion 101 comprises electricity-to-heat converters 103 and electrodes 104 formed on a substrate 102, which is a first substrate, an active-energy ray hardening material layer 210 having liquid passages 110, and a ceiling plate 106. In the foregoing recording head portion 101, a recording liquid 112 is supplied from a liquid reservoir chamber (not shown) to a common liquid chamber 108 through a liquid supply pipe 107.

Reference numeral 109 represents a connector for a liquid supply pipe. The recording liquid 112 supplied into the common liquid chamber 108 is supplied into the liquid passages 110 due to capillary action. Since a meniscus is formed in an ink discharge port 111 at the leading end of the liquid passage, the recording liquid 112 is stably held. When electric power is supplied to the electricity-to-heat converters 103, liquid on the electricity-to-heat converters 103 is heated so that bubble forming phenomenon takes place due to film boiling. Enlargement of the bubble causes a liquid droplet to be discharged through the ink discharge port 111. With the foregoing structure, an ink jet recording head portion can be formed which has multiple nozzles and which exhibits dense liquid passages such that the density of the discharge ports is 360 dots/inch to 400 dots/inch.

The present invention permits an excellent effect to be obtained when adapted to an ink jet recording apparatus among the ink jet recording methods that use heat energy to form a flying fluid droplet so as to perform the recording operation. As for the typical structure and the principle, it is preferable that the basic structure disclosed in, for example, U.S. Pat. No. 4,723,129 or 4,740,796 be employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which nucleate boiling takes place, are applied to the electricity-to-heat converter so as to generate heat energy in the electricity-to-heat converter and to cause film boiling to take place at the heat effecting surface of the recording head so that bubbles can be formed in the fluid (ink) to correspond to the drive signals. The enlargement/contraction of the bubble will cause the fluid (ink) to be discharged through a discharging opening so that one or more droplets are formed. If a pulse shaped drive signal is employed, the bubble can be enlarged/contracted immediately and properly, causing an additional preferred effect to be obtained because the fluid (ink) can be discharged with excellent responsiveness.

It is preferable that a pulse drive signal disclosed in U.S. Pat. No. 4,463,359 or 4,345,262 be employed. If conditions disclosed in U.S. Pat. No. 4,313,124, which relates to the temperature rising ratio at the heat effecting surface, are employed, a satisfactory recording result can be obtained.

As an alternative to the structure (linear fluid passage or perpendicular fluid passage) of the recording head disclosed in each of the aforesaid inventions and having an arrangement that discharge ports, fluid passages and electricity-to-heat converters are combined, a structure having an arrangement wherein the heat effecting surface is disposed in a bent region, as disclosed in U.S. Pat. No. 4,558,333 or 4,459,600, may be employed. In addition, the following structures may be employed: a structure having an arrangement that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section.

A chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally employ a recording head restoring means and an auxiliary means provided as a component of the present invention, because the effect of the present invention can be further stabilized. Specifically, it is preferable to employ any combination of a recording head capping means, a cleaning means, a pressurizing or suction means, an electricity-to-heat converter, an auxiliary heating element or a sub-heating means constituted by combining the converter and the auxiliary heating element and a controller for effecting a sub-discharge mode in which a discharge is performed independently of the recording discharge in order to stably perform the recording operation.

The recording apparatus may be arranged to be capable of recording a color-combined image composed of different colors or a full color image obtained by mixing colors with each other by integrally forming the recording head or by combining a plurality of recording heads as well as recording only a main color such as black.

Although a fluid ink is employed in each of the aforesaid embodiments of the present invention, ink which is solidified at room temperature or lower and softened at room temperature, or ink in the form of a fluid at room temperature, or ink which is formed into a fluid when the recording signal is supplied, may be employed.

Furthermore, ink of the following types can be adapted to the present invention: ink which is liquified when heat energy is supplied in response to the recording signal so as to be discharged in the form of fluid ink, the aforesaid ink being exemplified by ink wherein a temperature rise due to supply of the heat energy is positively prevented by utilizing the heat energy as an energy of state change from the solid state to the liquid state; and ink which is solidified when it is unused for the purpose of preventing the ink evaporation. Furthermore, ink which is first liquified when supplied with heat energy may be adapted to the present invention. In the aforesaid case, the ink may be of a type which is held as fluid or solid material in a recess of a porous sheet or a through hole at a position facing the electricity-to-heat converter, as disclosed in Japanese Patent Laid-Open No. 54-56847 or Japanese Patent Laid-Open No. 60-71260. It is most preferred that the ink be adapted to the aforesaid film boiling method.

Referring to FIG. 2, reference numeral 44 represents an ink detection sensor forming the ink detection means for determining whether or not ink exists, depending upon discharged ink traversing an optical axis of a light emitting device 44*a* and a light receiving device 44*b* of the transmission-type photointerrupter. The ink detection sensor 44 is disposed opposite to the cap 15 serving as the ink receiving means in the main scanning direction E. The foregoing disposition is employed in order to prevent contamination of the ink detection sensor 44 due to splashed ink when the recording head 1 is capped.

Figure 4:
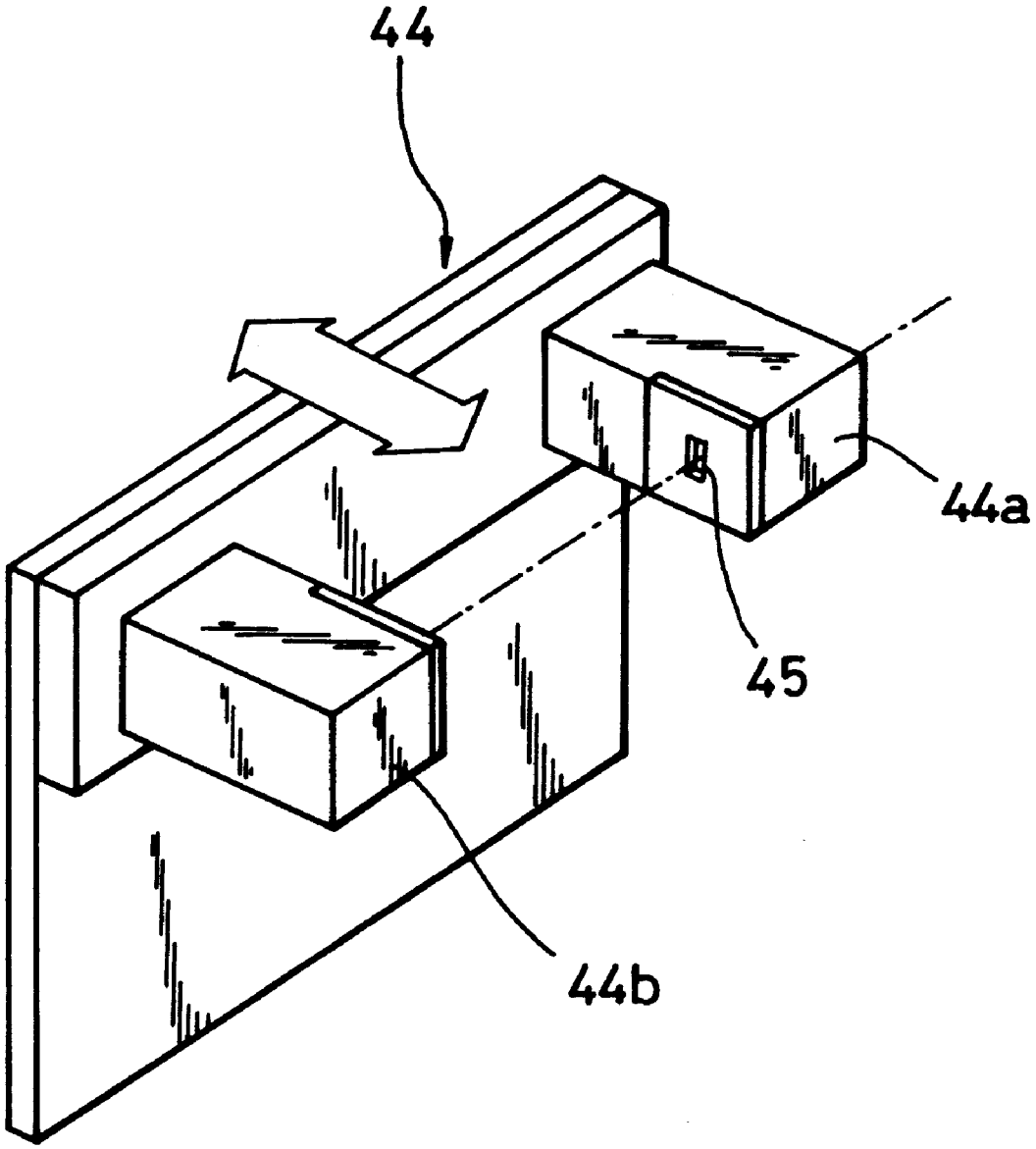
FIG. 4 is an enlarged perspective view of an ink detection sensor adapted to a photointerrupter method.

FIG. 4 is an enlarged view showing the transmission type photointerrupter structure ink detection sensor 44. A slit 45 is a gap permitting light emitted by the light emitting device 44*a* to pass through, the slit 45 having a rectangular shape having size of, for example, 0.5 mm×2.0 mm.

Figure 5:
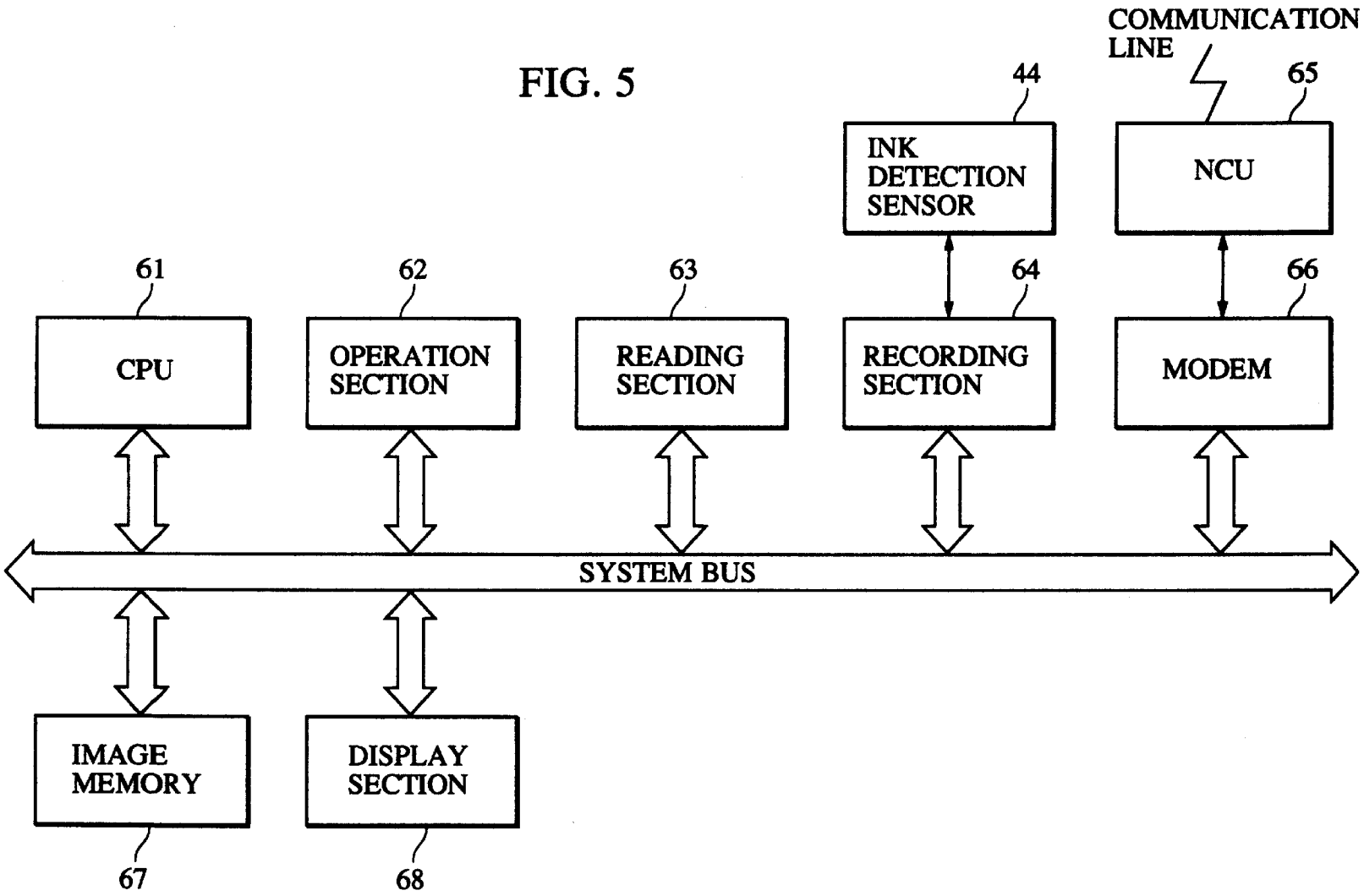
FIG. 5 is a block diagram showing the essential structure of the facsimile apparatus to which the present invention is applied.

FIG. 5 is a block diagram showing the essential portion of the facsimile apparatus according to this embodiment.

Referring to FIG. 5, flow of data will now be described. When a copying operation is performed, the user operates the operating section 62 so that a reading section 63 reads the stacked original document to transfer the read image data to a recording section 64 so that a recording operation is performed. When data is received, a transmission procedure transmitted through a communication line is processed by a CPU (Central Processing Unit) 61 through an NCU (Network Control Unit) 65 and a modem 66 so that transmission of image data is commenced. Transferred image data is allowed to pass through the NCU 65 and modem 66 so as to be temporarily stored in an image memory 67. Then, similar to the foregoing copying operation, image data is transferred to a recording section 64 so as to be recorded on the recording sheet.

When a defect occurring in the ink discharge is to be detected for the purpose of performing usual detection of the residual quantity of ink, the carriage 2 is temporarily shifted toward the home position so that the light-shield plate 2*b* provided on the carriage 2 shields the carriage home sensor 10. Thus, the position of the carriage 2 is corrected. When the CPU 61 has caused the light emitting device 44*a* of the ink detection sensor 44 to emit light, the carriage 2 starts moving toward the ink detection sensor 44. During the movement of the carriage 2 from the home position toward the opposite end at which the ink detection sensor 44 is disposed, an ink discharge command is issued from the CPU 61 to the recording section 64 so as to cause ink discharged from the recording head 1 to traverse the optical axis of light transmitted through the slit 45. The widths of the pulses, which are binary-coded output waveforms, are counted by the CPU 61 as output values so as to store the count in a register therein. The CPU 61 determines whether or not ink exists in accordance with the stored output value. That is, if the pulse width is not larger than a predetermined threshold, the optical axis was not shielded by the discharged ink. In that case, a command for causing a display section 68 to display occurrence of a defect in ink discharge is issued.

When malfunction of the ink detection sensor 44 is checked, ink is not discharged from the recording head 1 of the recording section 64. In this case, the CPU 61 causes the light emitting device 44*a* of the ink detection sensor 44 to emit light. The widths of the binary-coded output pulses from the ink detection sensor 44 are counted by the CPU 61 as output values and stored in the register therein. The CPU 61 then determines whether or not the ink detection sensor 44 has encountered a malfunction. If the pulse width is larger than a predetermined threshold, the optical axis was interrupted although no ink was discharged from the recording head 1. In that case, a determination is performed that the ink detection sensor 44 has encountered a malfunction, and a command is issued to cause the display section 68 to display the malfunction of the ink detection sensor 44. In accordance with the display showing the malfunction of the ink detection sensor 44, the operator removes ink mist adhered to the slit 45 or removes the generated deposits to recover the normal operation of the operation of the ink detection sensor 44. As an alternative to this, the normal state may be recovered by changing the ink detection sensor 44.

Figure 6:
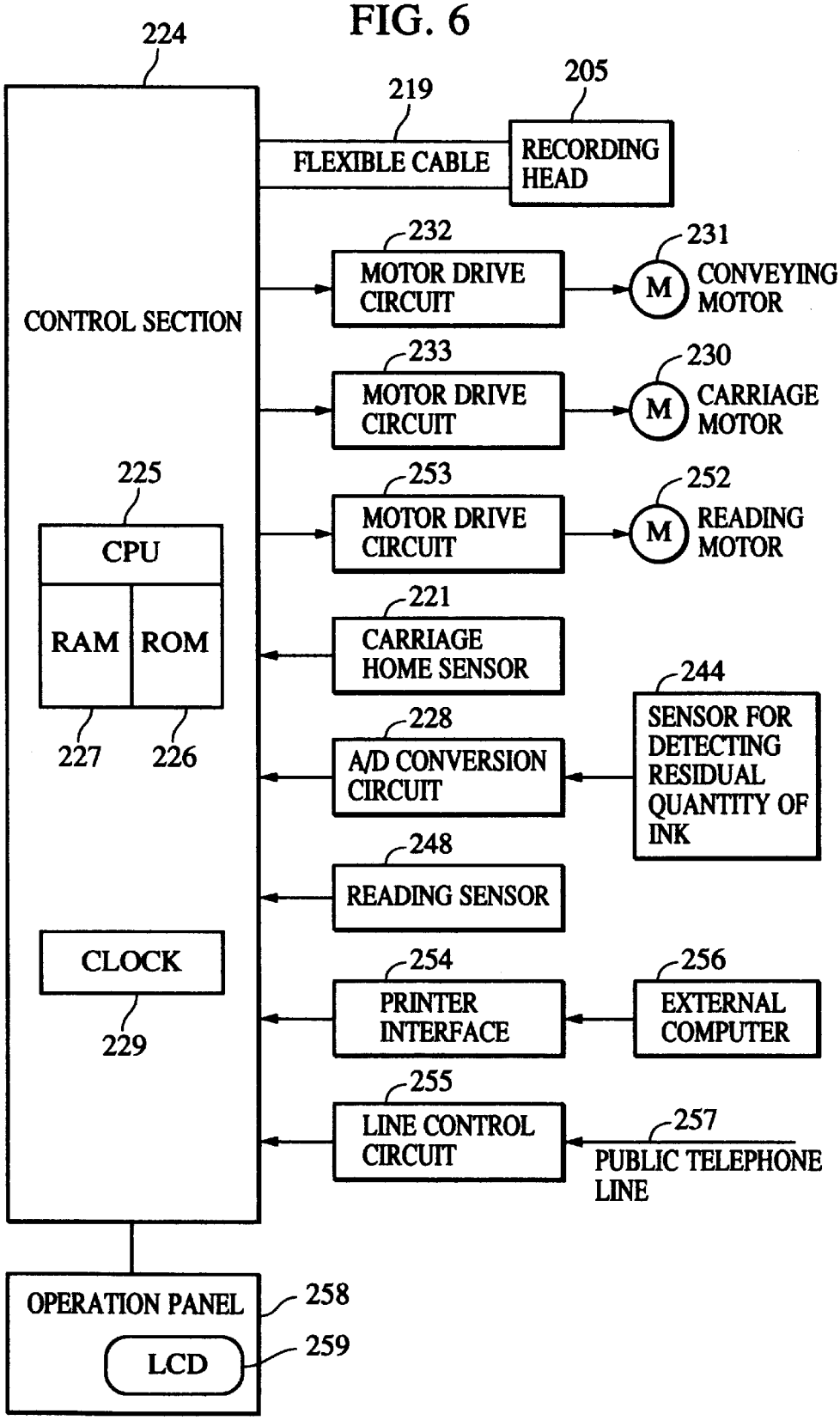
FIG. 6 is a block diagram of the control structure of the facsimile apparatus to which the present invention is applied.

FIG. 6 is a block diagram showing the structure for controlling the facsimile apparatus shown in FIG. 1.

Referring to FIG. 6, reference numeral 224 represents a control section. The control section 224 comprises a CPU 225, a ROM 226 for storing a program for the control performed by the CPU 225 and various data items and a RAM 227 for use as a working area for the CPU 225 to perform a variety of processes or temporarily store various data items. A portion of the ROM 226 is formed into an EEPROM for storing information about the ink discharge position when the operation for detecting the residual quantity of ink (to be described later) is performed.

As shown in FIG. 6, the recording head 205 is connected to the control section 224 through a flexible cable 219. The flexible cable 219 includes a control signal line and an image signal line arranged from the control section 224 to the recording head 205. The output from the sensor 244 for detecting the residual quantity of ink is digitized by an A/D conversion circuit 228 so as to be analyzed by the CPU 225. A carriage motor 230 is a motor which can be rotated in accordance with the number of pulse steps supplied from a motor drive circuit 233. The control section 224 controls the carriage motor 230 through the motor drive circuit 233, controls a conveying motor 231 through a motor drive circuit 232 and controls a reading motor 252 through a motor drive circuit 253. The control section 224 receives the output from the carriage home sensor 221.

Image data input apparatuses are connected to the control section 224, the image data input apparatuses being a reading sensor 248, a printer interface 254 for receiving a recording command and data to be recorded supplied from an external computer 256, and a line control circuit 255 for receiving data received from a public telephone line 257. Thus, the control section 224 is able to act as a facsimile machine, a copying machine and a printer for the external computer. Moreover, an operating panel 258 with which a user of the apparatus performs various operations and issues instructions is connected to the control section 224. The operating panel 258 has a liquid crystal display unit (LCD) 259 for displaying messages. The operating panel 258 is provided with a switch (not shown) for instructing the sensor 244 to detect the residual quantity of ink.

Figure 7:
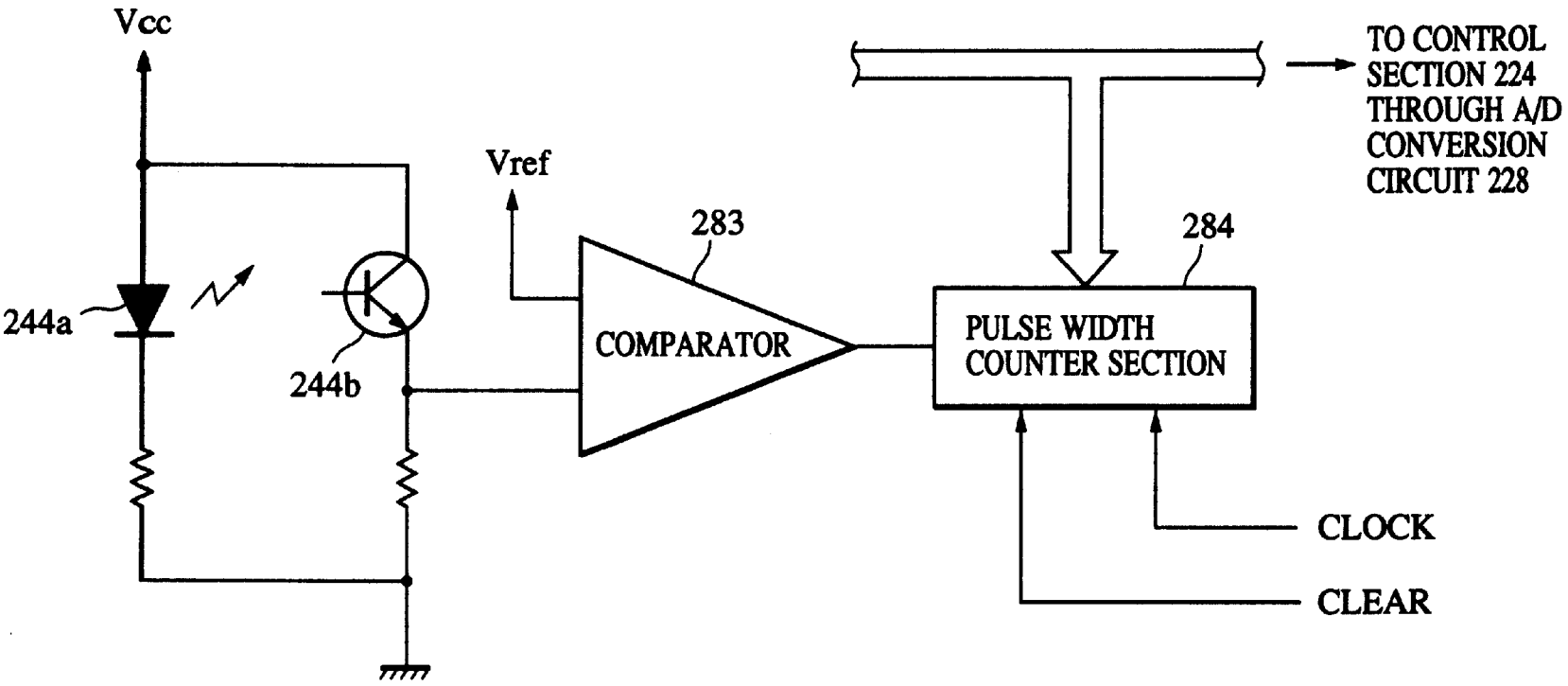
FIG. 7 is a block diagram of the electrical structure of the ink detection sensor.

FIG. 7 is a block diagram showing the electrical structure of the sensor 244 for detecting the residual quantity of ink. Referring to FIG. 7, reference numeral 244*a* represents an infrared light emitting diode (LED) supplied with a voltage Vcc, 244*b* represents a phototransistor which is a light receiving device for receiving the infrared light, 283 represents a comparator which receives an output from the phototransistor 244*b* and compares that output with a predetermined reference voltage (Vref), and 284 represents a pulse-width counter portion for counting the continuation time (the pulse width) of the pulses transmitted from the comparator 283. The pulse-width counter section 284 uses the pulse width of a reference clock as the reference pulse width so as to count the number of cycles of the reference clock to which the continuation time of the pulses transmitted from the comparator 283 correspond. The counted value is transmitted to the internal register of the pulse-width counter section 284.

If no ink has been discharged from the recording head 205, infrared light emitted from the infrared LED 244*a*, which is the light emitting device, is not interrupted. Therefore, a high-level (H) signal is supplied from the phototransistor 244*b* to the comparator 283. If ink has been discharged from the recording head 205, the discharged ink interrupts the infrared light emitted from the infrared LED 244*a*. Therefore, the level of the outputs from the phototransistor 244*b* is gradually lowered. If the level of the outputs is lowered to a level lower than the reference voltage (Vref) supplied to the comparator 283, the output from the comparator 283 to the pulse-width counter section 284 is inverted. After discharge of ink from the recording head 205 has been completed, the output from the phototransistor 244*b* is again made to be high (H) level. If the level is made to be higher than the reference voltage (Vref) supplied to the comparator 283, the output from the comparator 283 to the pulse-width counter section 284 is again inverted.

As described above, the pulse-width counter section 284 receives the pulses, the width of which is the time for which the sensor 244 detects the residual quantity of ink. As described above, the pulse width is measured by using the reference clock so as to be stored in the register in the pulse-width counter section 284. The counted value is read by the CPU 225 of the control section 224 after the ink discharge has been completed, so as to be used to perform a determination whether ink exists.

Note that the frequency of the reference clock for use in this embodiment is about 56.5 kHz, and the threshold used to perform the determination whether ink has been discharged is set to be 80 pulses.

First Embodiment (Timer Checks Ink Detection Sensor at Predetermined Intervals)

Figure 8A:
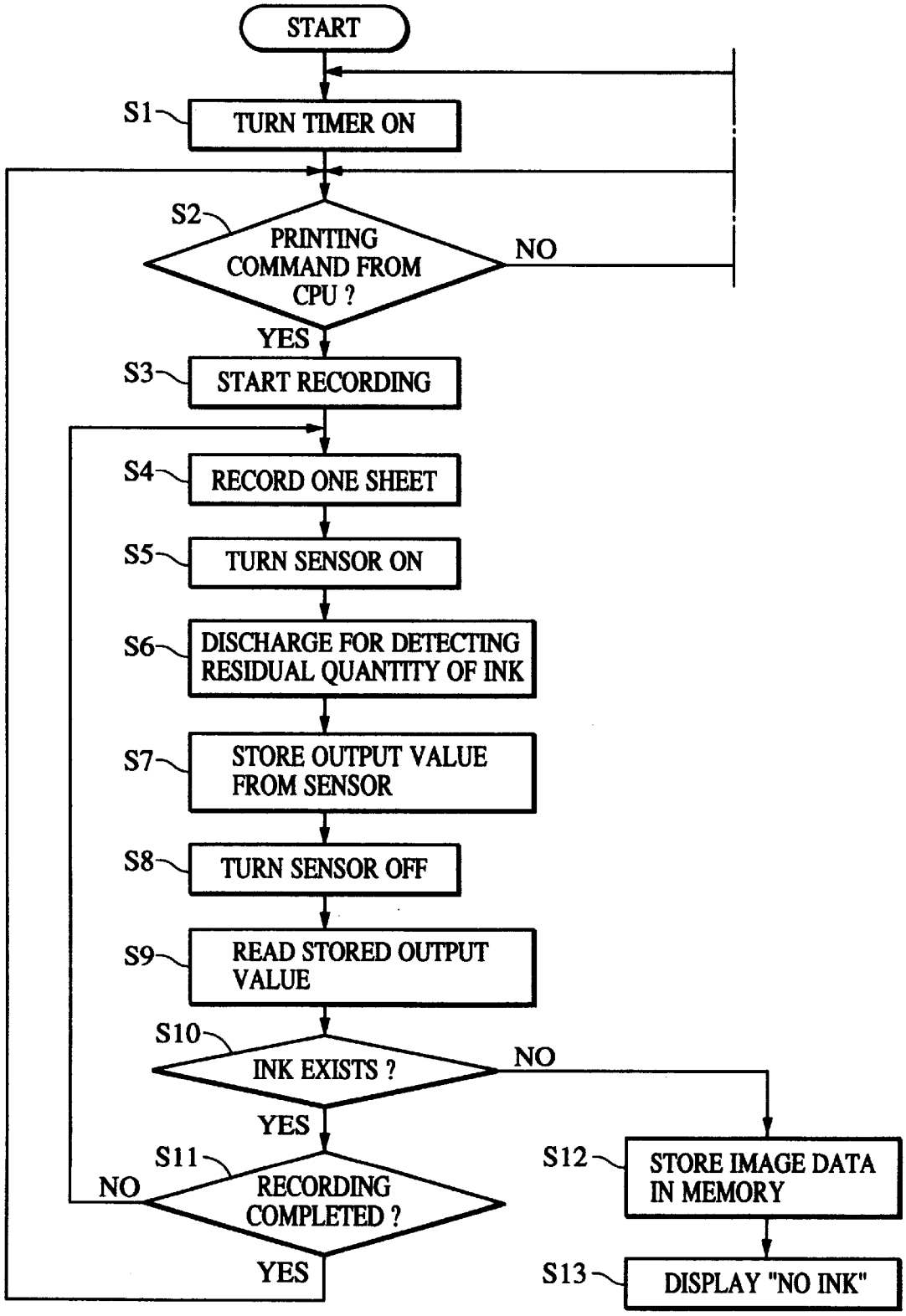
FIGS. 8A and 8B are flow charts of an operation for detecting the residual quantity of ink and malfunction of the ink detection means according to a first embodiment of the present invention.
Figures 8, 8B:
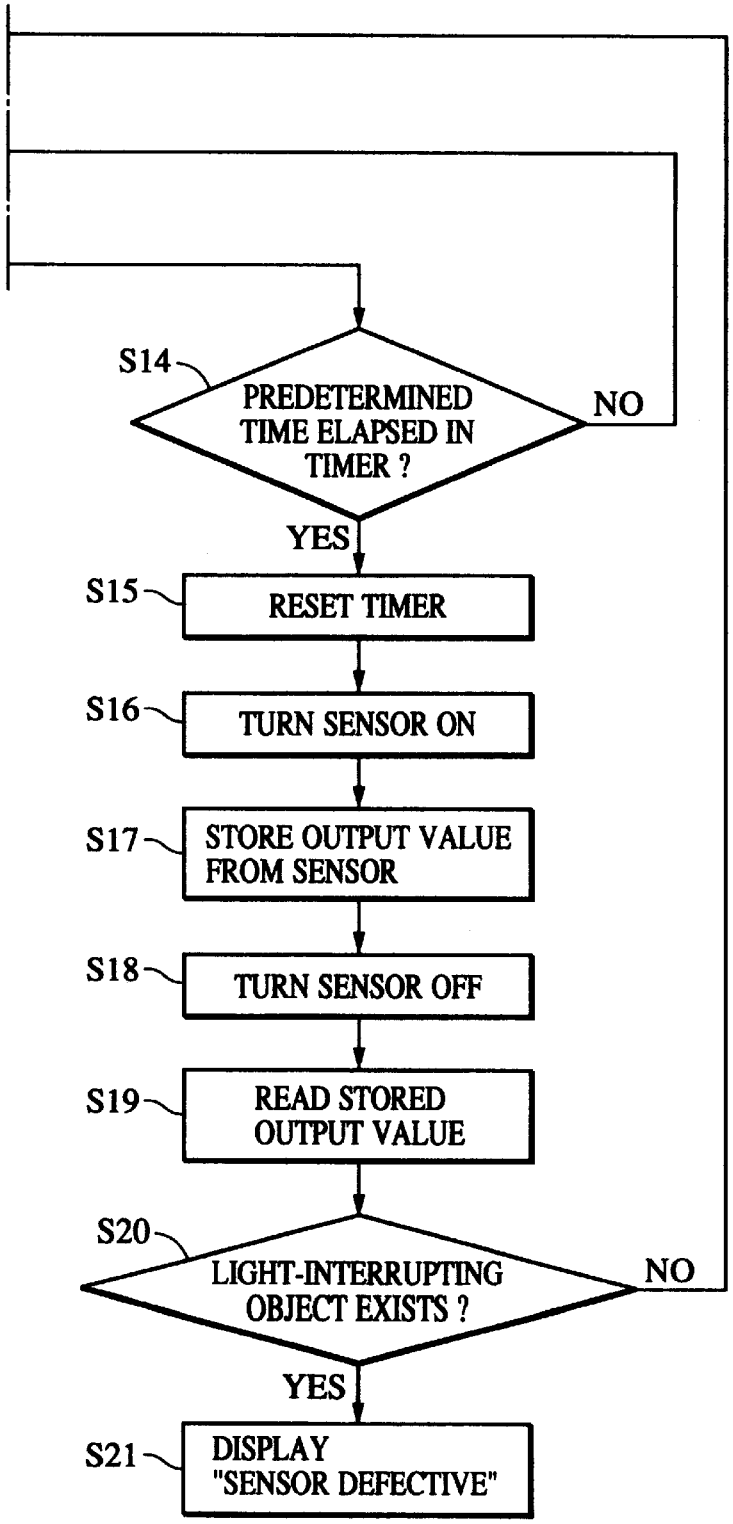
FIG. 8 is a block diagram showing that FIGS. 8A and 8B are to be read as connected flow charts.

FIG. 8 shows the operation to be performed by the CPU 61 to detect the residual quantity of ink and the malfunction of the ink detection means according to a first embodiment of the present invention.

In step S1 a timer is turned on. The timer is turned on when, for example, the power source is turned on. If a determination is performed in step S2 that a printing command has been issued, a recording operation starts. In step S3 the recording operation starts. In step S4 one sheet is recorded. After one sheet has been recorded, the light emitting device 44*a* of the ink detection sensor 44 is caused to emit light in step S5. In step S6 ink is discharged from the recording head 1 in a predetermined quantity; for example, 40 droplets from all nozzles to shield the optical axis of the ink detection sensor 44. In step S7 the output value from the ink detection sensor 44 when ink has been discharged as described above is stored in the register in the CPU 61. In step S8 light emission from the light emitting device 44*a* of the ink detection sensor 44 is interrupted. In step S9 the CPU 61 reads the output value from the ink detection sensor 44 stored in the register in the CPU 61. In accordance with the read value, the CPU 61 determines in step S10 whether or not ink exists. If a determination has been made that ink exists, it is determined in step S11 whether all of the printing commands issued from the CPU 61 in step S2 have been completed. The determination whether or not ink exists can be performed in such a manner that the time for which the optical axis is interrupted by ink is made to be an output value and a determination is performed as to whether the output value is larger than a predetermined threshold. That is, if the time is shorter than the predetermined time, a determination can be performed that the residual quantity of ink has been reduced, or that a defect in discharge has taken place in the recording head 1. If all of the recording operations have been completed, a next printing command is waited for. If all of the recording operations have not been completed, recording of a next one sheet is commenced. If a determination is performed in step S10 that no ink exists, the image data may not have been completely recorded on the recording sheet. Therefore, the image data is stored in step S12, and a display indicating that no ink exists is performed in step S13 to issue an alarm to a user. Note that this display may be performed to indicate that the discharge of ink encountered a defect. In accordance with the display, the user is able to change the ink carriage or perform the ink discharge recovery operation.

If no printing command has been issued in step S2, the operation proceeds to step S14 so that a determination is performed as to whether a predetermined time has elapsed in the timer. If a predetermined time has not elapsed in the timer, the operation returns to step S2 so that a determination is performed as to whether a printing command has been issued from the CPU. If a determination is performed in step S14 that a predetermined time has passed, the operation proceeds to step S15 so that the timer is reset. In step S16 the light emitting device 44*a* of the ink detection sensor 44 is caused to emit light. At this time, ink is not discharged from the recording head 1 as described above. In step S17 the output value from the ink detection sensor 44 is stored in the register in the CPU 61. In step S18 light emission from the light emitting device 44a of the ink detection sensor 44 is interrupted. In step S19 the CPU 61 reads the output value from the ink detection sensor 44 stored in the register in the CPU 61. In accordance with the read value, the CPU 61 determines in step S20 whether an interrupting object exists. If a determination is performed that an interrupting object exists, the display section 68, serving as a notifying means, displays that the sensor is defective in step S21, thereby issuing an alarm to the user. After the sensor has been turned on in step S16, ink is not discharged from the recording section 64 to shield the optical axis of the ink detection sensor 44. Therefore, the determination in step S20 that an interrupting object exists means that the ink detection sensor 44 has made an error in detection due to contamination or the like. If a determination is performed by the CPU 61 in step S20 that no interrupting object exists, a determination is performed that the operation of the ink detection sensor 44 is normal. Thus, the operation returns to step S1 in which the timer is turned on.

Second Embodiment (Ink Detection Sensor is Checked Whenever the Head Carriage is Changed)

Figure 9A:
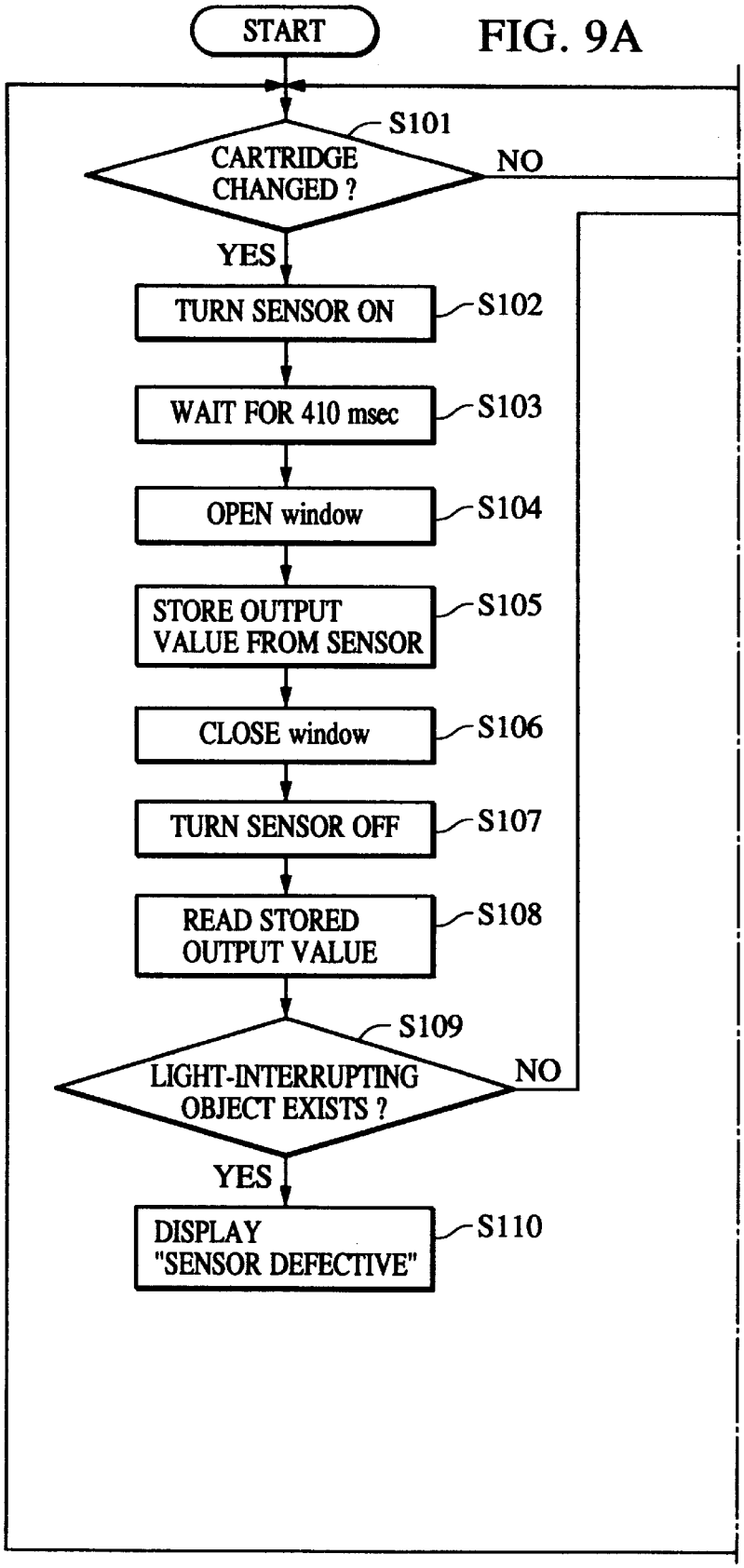
FIGS. 9A and 9B are flow charts of an operation for detecting the residual quantity of ink and malfunction of the ink detection means according to a second embodiment of the present invention.
Figures 9, 9B:
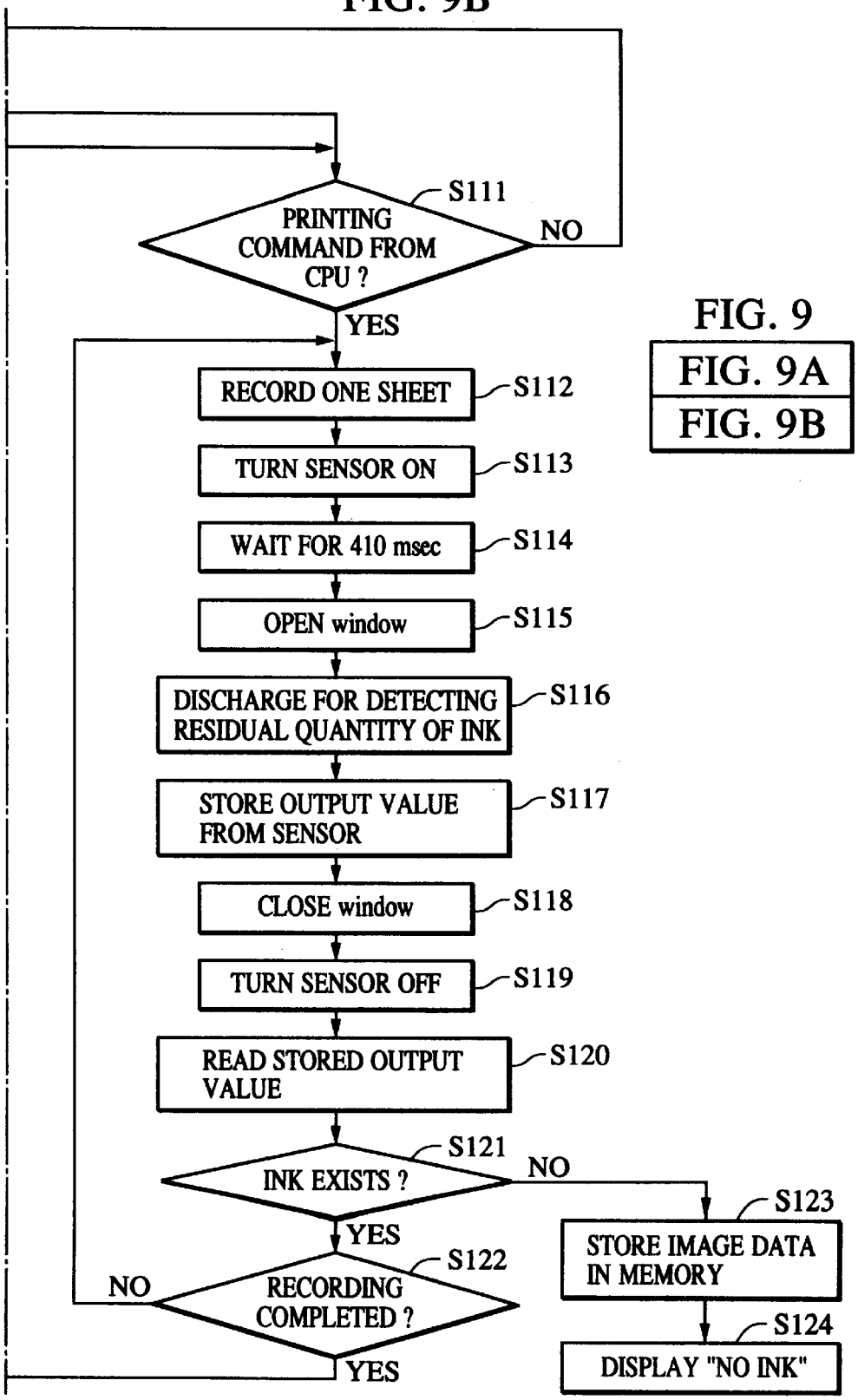
FIG. 9 is a block diagram showing that FIGS. 9A and 9B are to be read as connected flow charts.

FIG. 9 shows the operation to be performed by the CPU 61 to detect the residual quantity of ink and the malfunction of the ink detection means according to a second embodiment of the present invention.

In step S101 a method for detecting whether an electrical contact between a carriage and a head cartridge has been turned on or off is employed or a determination is performed by using a mechanical switch to determine whether or not the head cartridge has been changed. If a determination has been performed that the head cartridge has been changed, the light emitting device 44*a* of the ink detection sensor 44 is caused to emit light in step S102.

In step S103 waiting is performed for 410 msec from a moment the ink detection sensor 44 has been turned on to ensure that the quantity of light emission from the ink detection sensor 44 has become stable. In step S104 "window OPEN", monitoring of the output from the ink detection sensor 44 is commenced in a state where ink is not discharged in such a manner that ink shields the optical axis of the ink detection sensor 44. In step S105 the output value from the ink detection sensor 44 is stored in the register in the CPU 61. In step S106 "window CLOSE", monitoring of the output from the ink detection sensor 44 is interrupted. In step S107 light emission from the light emitting device 44*a* of the ink detection sensor 44 is interrupted. In step S108 the CPU 61 starts reading of the output value from the ink detection sensor 44 stored in the register. In accordance with the read output value, the CPU 61 determines in step S109 whether or not a light-interrupting object exists. If a determination is performed that an interrupting object exists, the display section displays that the ink detection sensor 44 is defective in step S110 to issue an alarm to the user.

Note that the reason why the output from the ink detection sensor 44 is monitored in only a period from "window OPEN" to "window CLOSE" is that the influence of noise which can be generated when the ink detection sensor 44 is turned on or off must be eliminated.

If a determination has been performed in step S101 that the head cartridge has not been changed and/or if a determination has been performed in step S109 that no interrupting object exists, the operation proceeds to step Sill to determine whether or not a printing command has been issued from the CPU. If a printing command has been issued, one sheet is recorded in step S112. After one sheet has been recorded, the light emitting device 44*a* of the ink detection sensor 44 is caused to emit light in step S113. In step S114 waiting is performed for 410 msec from a moment the ink detection sensor 44 has been turned on to ensure that the quantity of light emission from the ink detection sensor 44 has become stable. In step S115 "window OPEN", monitoring of the output from the ink detection sensor 44 is commenced. In step S116 ink is discharged in a predetermined quantity to shield the optical axis of the ink detection sensor 44.

In this embodiment, an ink jet head having 128 nozzles is used to cause each nozzle to discharge 40 droplets. In step S117 the output value from the ink detection sensor 44 is stored in the register in the CPU 61. Then, monitoring of the output from the ink detection sensor 44 is interrupted in step S118 "window CLOSE". In step S119 light emission from the light emitting device 44*a* of the ink detection sensor 44 is interrupted. In step S120 the CPU 61 reads the output value from the ink detection sensor 44 stored in the register. In accordance with the read output value, a determination is performed by the CPU 61 in step S121 as to whether ink exists. If a determination is performed that ink exists, it is determined in step S122 whether or not printing has been completed in accordance with the printing command issued from the CPU 61 in step S111. If all of the recording operations have been completed, the operation returns to step S101 so that change of the head cartridge is monitored.

If all of the recording operations have not been completed, the operation returns to step S112 so that recording of a next sheet is commenced. If a determination is performed in step S121 that no ink exists, the image data may not have been completely recorded on the recording sheet. Therefore, the image data is stored in step S123, and a display indicating that no ink exists is performed in step S124 to issue an alarm to a user.

Although this embodiment has the structure such that the ink detection sensor is checked whenever the head cartridge is changed, the operation of checking the ink detection sensor may be performed whenever an ink tank for supplying ink to the recording head is changed in a case where a structure is employed in which the ink tank can be separated from the recording head.

Third Embodiment (Ink Detection Sensor is Checked Before an Operation for Detecting the Residual Quantity of Ink is Performed)

Figure 10A:
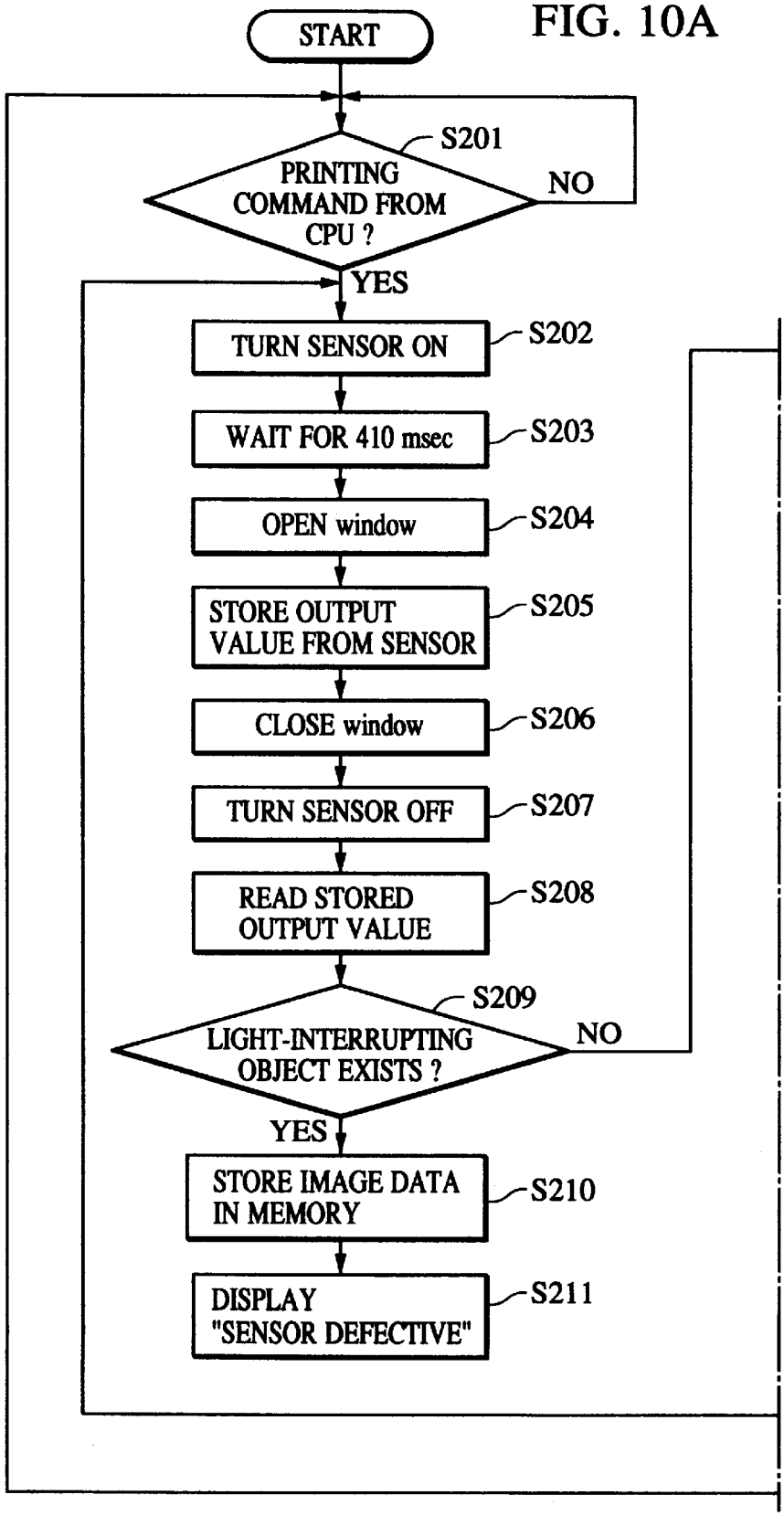
FIGS. 10A and 10B are flow charts of an operation for detecting the residual quantity of ink and malfunction of the ink detection means according to a third embodiment of the present invention.
Figures 10, 10B:
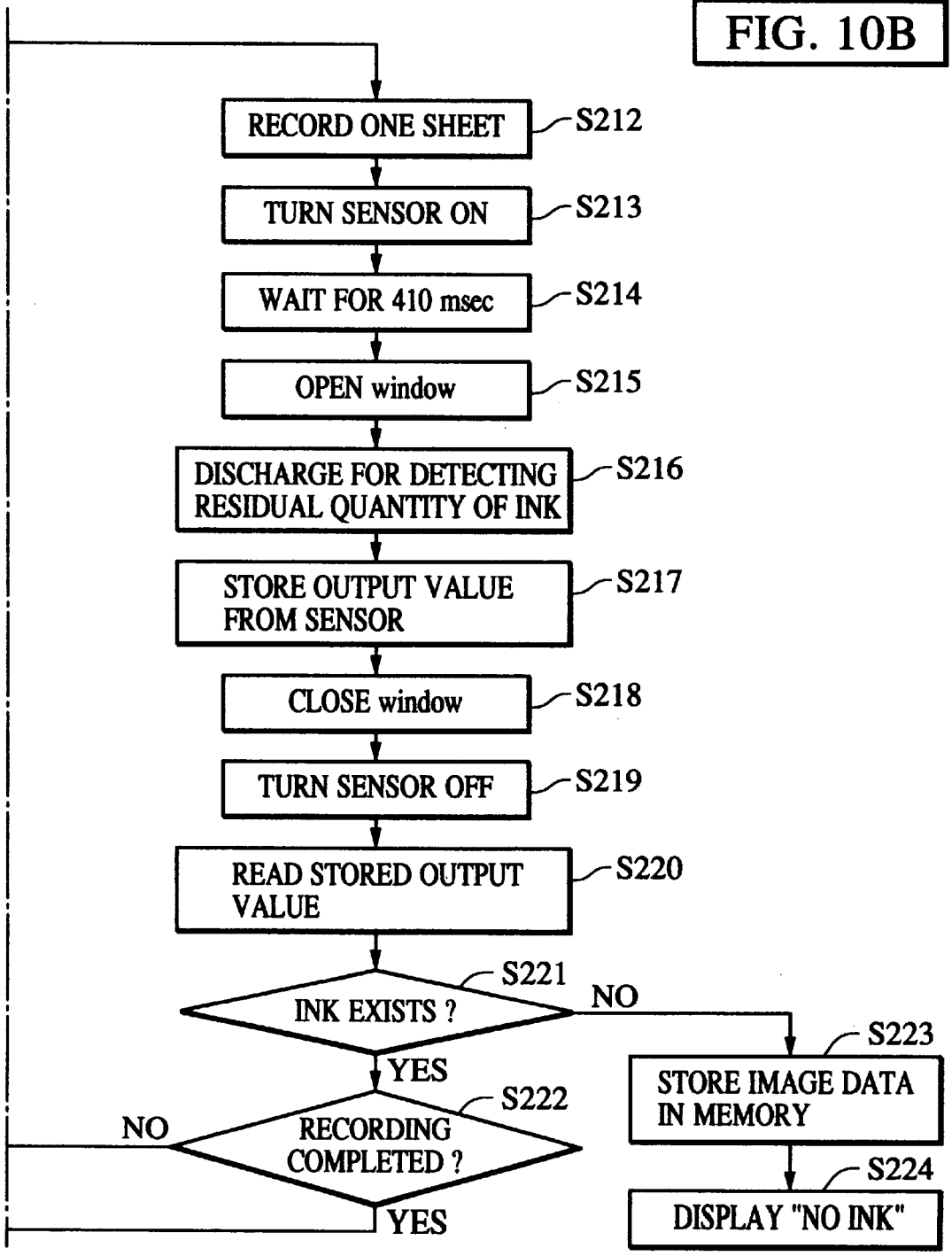
FIG. 10 is a block diagram showing that FIGS. 10A and 10B are to be read as connected flow charts.

FIG. 10 shows the operation to be performed by the CPU 61 to detect the residual quantity of ink and the malfunction of the ink detection means according to a third embodiment of the present invention.

If no printing command has not been issued in step S201, the operation returns to the standby state in which issue of the printing command is waited for. If the printing command has been issued in step S201, the light emitting device 44*a* of the ink detection sensor 44 is caused to emit light in step S202.

In step S203 waiting is performed for 410 msec from a moment the ink detection sensor 44 has been turned on to ensure that the quantity of light emission from the ink detection sensor 44 has become stable. In step S204 "window OPEN", monitoring of the output from the ink detection sensor 44 is commenced in a state where ink is not discharged in such a manner that ink shields the optical axis of the ink detection sensor 44. In step S205 the output value from the ink detection sensor 44 is stored in the register in the CPU 61.

In step S206 "window CLOSE", monitoring of the output from the ink detection sensor 44 is interrupted. In step S207 light emission from the light emitting device 44*a* of the ink detection sensor 44 is interrupted. In step S208 the CPU 61 starts reading the output value from the ink detection sensor 44 stored in the register. In accordance with the read output value, the CPU 61 determines in step S209 whether a light-interrupting object exists. If a determination is performed that an interrupting object exists, a fact that the ink detection sensor 44 is defective is displayed on the display section in step S210 to issue an alarm to the user.

If the CPU 61 determines in step S209 that no interrupting object exists, the recording operation is commenced. In step S212 one sheet is recorded. After one sheet has been recorded, the light emitting device 44*a* of the ink detection sensor 44 is caused to emit light in step S213. In step S214 waiting is performed for 410 msec from a moment the ink detection sensor 44 has been turned on to ensure that the quantity of light emission from the ink detection sensor 44 has become stable. In step S215 "window OPEN", monitoring of the output from the ink detection sensor 44 is commenced. In step S216 ink is discharged in a predetermined quantity to shield the optical axis of the ink detection sensor 44.

In this embodiment, an ink jet recording head having 128 nozzles is used to cause each nozzle to discharge 40 droplets. In step S217 the output value from the ink detection sensor 44 is stored in the register in the CPU 61. Then, monitoring of the output from the ink detection sensor 44 is interrupted in step S218 "window CLOSE". In step S219 light emission from the light emitting device 44*a* of the ink detection sensor 44 is interrupted. In step S220 the CPU 61 reads the output value from the ink detection sensor 44 stored in the register.

In accordance with the read output value, a determination is performed by the CPU 61 in step S221 whether or not ink exists. If a determination is performed that ink exists, it is determined in step S222 whether or not printing has been completed in accordance with the printing command issued from the CPU 61 in step S201. If all of the recording operations have been completed, a next printing command is waited for. If all of the recording operations have not been completed, the operation returns to step S202 so that the ink detection sensor 44 is checked. If a determination is performed in step S221 that no ink exists, the image data may not have been completely recorded on the recording sheet. Therefore, image data is stored in step S223, and a display indicating that no ink exists is performed in step S224 to issue an alarm to a user.

Fourth Embodiment (Ink Detection Sensor is Checked Whenever a Predetermined Time Has Passed in the Timer)

Figure 11A:
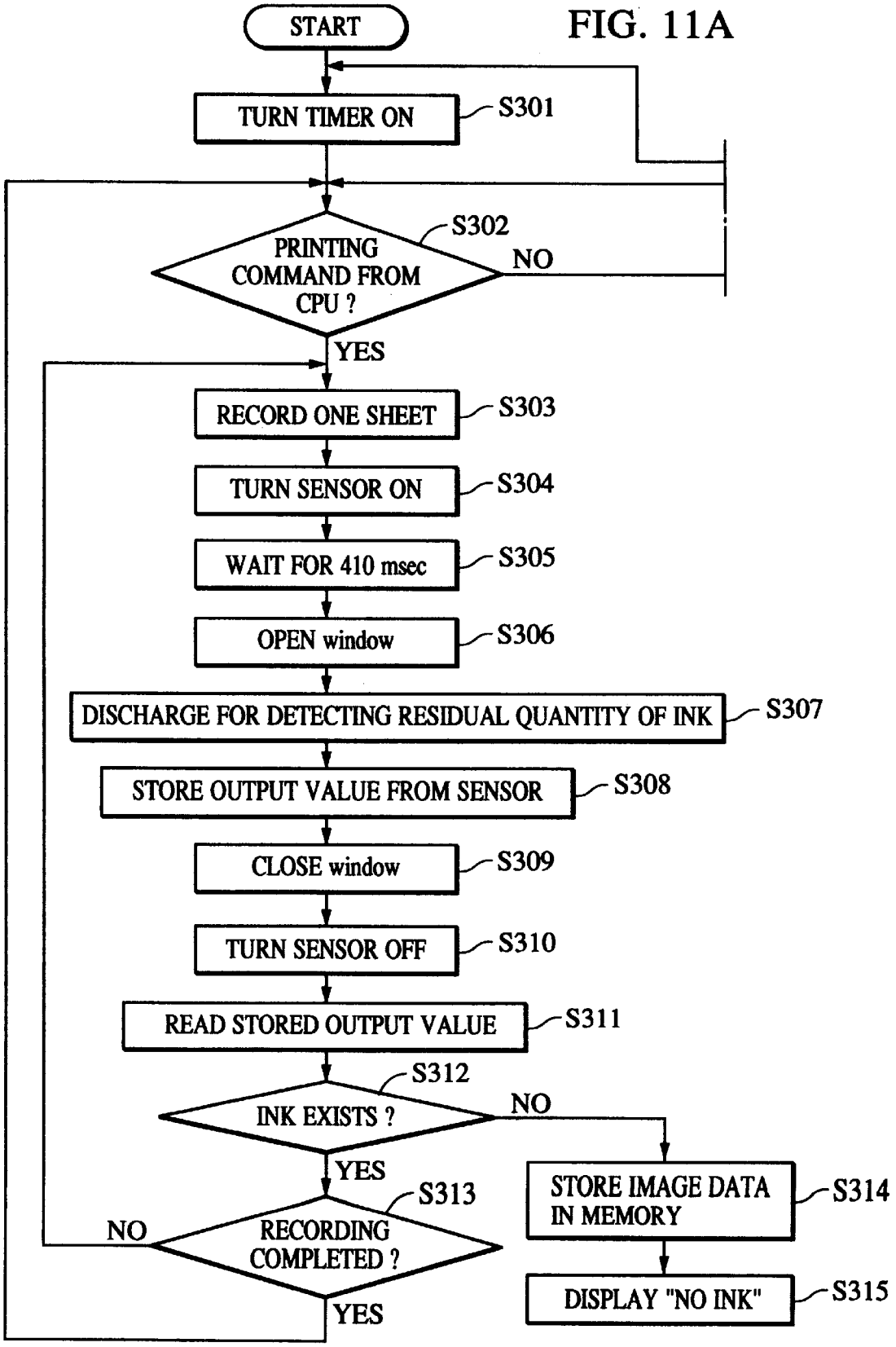
FIGS. 11A and 11B are flow charts of an operation for detecting the residual quantity of ink and malfunction of the ink detection means according to a fourth embodiment of the present invention.
Figures 11, 11B:
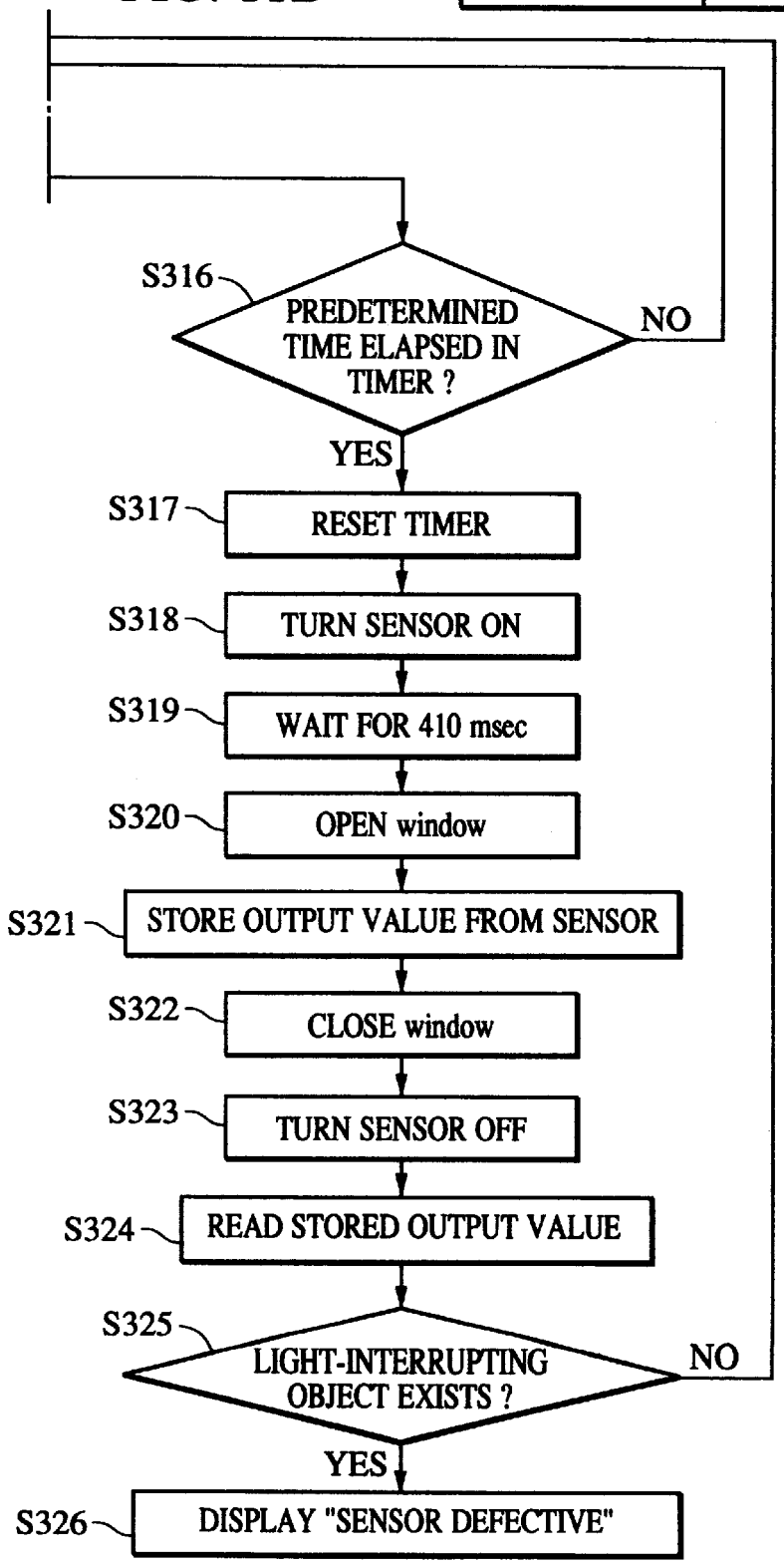
FIG. 11 is a block diagram showing that FIGS. 11A and 11B are to be read as connected flow charts.

FIG. 11 shows the operation to be performed by the CPU 61 to detect the residual quantity of ink and the malfunction of the ink detection means according to a fourth embodiment of the present invention.

In step S301 a timer is turned on simultaneously with turning on of the power source. In step S302 it is determined whether or not a printing command has been issued from the CPU. If a printing command has been issued, the recording operation starts. In step S303 one sheet recording is performed. After one sheet has been recorded, the light emitting device 44*a* of the ink detection sensor 44 is caused to emit light in step S304.

In step S305 waiting is performed for 410 msec from a moment the ink detection sensor 44 has been turned on to ensure that the quantity of light emission from the ink detection sensor 44 has become stable. In step S306 "window OPEN", monitoring of the output from the ink detection sensor 44 is commenced in a state where ink is not discharged in such a manner that ink shields the optical axis of the ink detection sensor 44. In step S307 ink is discharged in a predetermined quantity to shield the optical axis of the ink detection sensor 44.

In this embodiment, an ink jet head having 128 nozzles is used to cause each nozzle to discharge 40 droplets. In step S308 the output value from the ink detection sensor 44 is stored in the register in the CPU 61. Then, monitoring of the output from the ink detection sensor 44 is interrupted in step S309 "window CLOSE". In step S310 light emission from the light emitting device 44*a* of the ink detection sensor 44 is interrupted. In step S311 the CPU 61 reads the output value from the ink detection sensor 44 stored in the register. In accordance with the read output value, a determination is performed by the CPU 61 in step S312 whether or not ink exists. If a determination is performed that ink exists, it is determined in step S313 whether or not printing has been completed in accordance with the printing command issued from the CPU 61 in step S302 is determined in step S313.

If all of the recording operations have been completed, a next printing command is waited for. If all of the recording operations have not been completed, recording of a next one sheet is commenced. If a determination has been performed in step S312 that no ink exists, the image data may not have been completely recorded on the recording sheet. Therefore, image data is stored in step S314, and display indicating that no ink exists is performed in step S315 to issue an alarm to a user.

If no printing command has been issued in step S302, the operation proceeds to step S316 so that a determination is performed whether or not a predetermined time has elapsed in the timer. If a predetermined time has not been elapsed in the timer, the operation returns to step S302. If a determination is performed in step S316 that a predetermined time has passed, the operation proceeds to step S317 so that the timer is reset. In step S318 the light emitting device 44*a* of the ink detection sensor 44 is caused to emit light.

In step S319 waiting is performed for 410 msec from a moment the ink detection sensor 44 has been turned on to ensure that the quantity of light emission from the ink detection sensor 44 has become stable. In step S320 "window OPEN", monitoring of the output from the ink detection sensor 44 is commenced in a state where ink is not discharged in such a manner that ink shields the optical axis of the ink detection sensor 44. In step S321 the output value from the ink detection sensor 44 is stored in the register in the CPU 61.

In step S322 "window CLOSE", monitoring of the output from the ink detection sensor 44 is interrupted. In step S323 light emission from the light emitting device 44*a* of the ink detection sensor 44 is interrupted. In step S324 the CPU 61 starts reading of the output value from the ink detection sensor 44 stored in the register in the recording section. In accordance with the read output value, the CPU 61 determines in step S325 whether or not a light-interrupting object exists. If a determination is performed that an interrupting object exists, the display section displays that the ink detection sensor 44 is defective in step S326 to issue an alarm to the user.

If a determination is performed by the CPU 61 in step S325 that no interrupting object exists, the operation returns to step S301 to re-start the timer.

In the foregoing embodiments, the output value from the ink detection sensor is processed such that an analog output is binary-coded and the binary-coded value is used as the output time. The clock frequency is about 56.5 kHz. The threshold for determining whether or not an insulating object exists is set to be 10. The threshold for determining whether or not ink exists is set to be 100.

As described above, according to this embodiment, the apparatus can determine the fact that the ink detection sensor cannot perform detection due to contamination of the light emitting device and/or the light receiving device with ink mist during the normal recording operation. Therefore, the user is able to detect a malfunction of the ink detection sensor due to contamination or the like. Therefore, the user is able to perform recovery of the operation of the ink detection sensor. Thus, an advantage can be obtained in that the reliability of the apparatus can be improved.

According to the foregoing embodiment, whether or not the ink detection sensor has encountered a malfunction can automatically be detected whenever a predetermined time has passed. Therefore, the malfunction of the ink detection sensor can efficiently be detected without the necessity of interrupting the recording operation.

Fifth Embodiment (Ink Detection Sensor is Checked Before Recording Operation is Performed in Accordance with Image Information)

Figure 12:
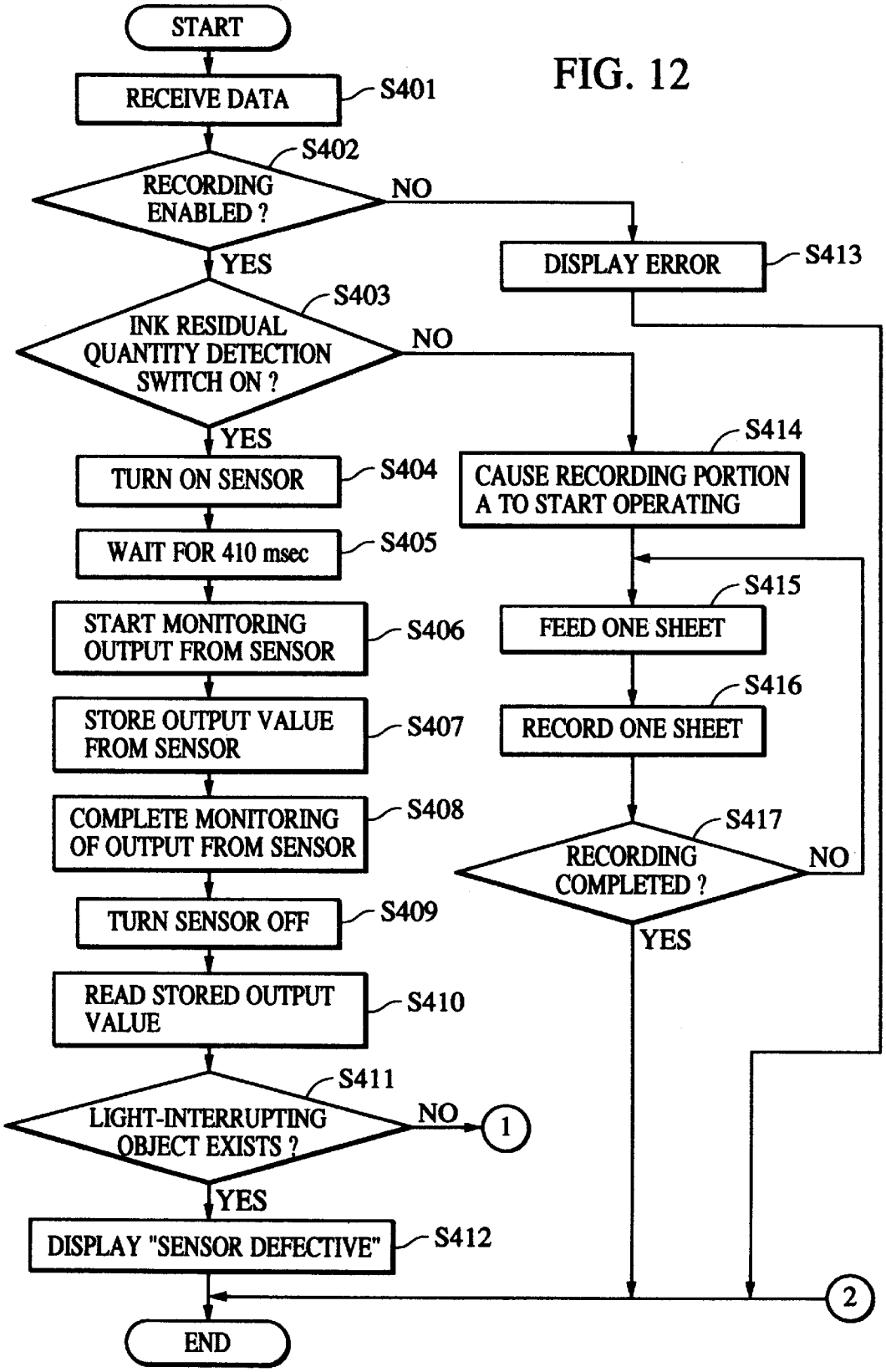
FIG. 12 is a flow chart of an operation for detecting the residual quantity of ink and malfunction of the ink detection means according to a fifth embodiment of the present invention.
Figure 13:
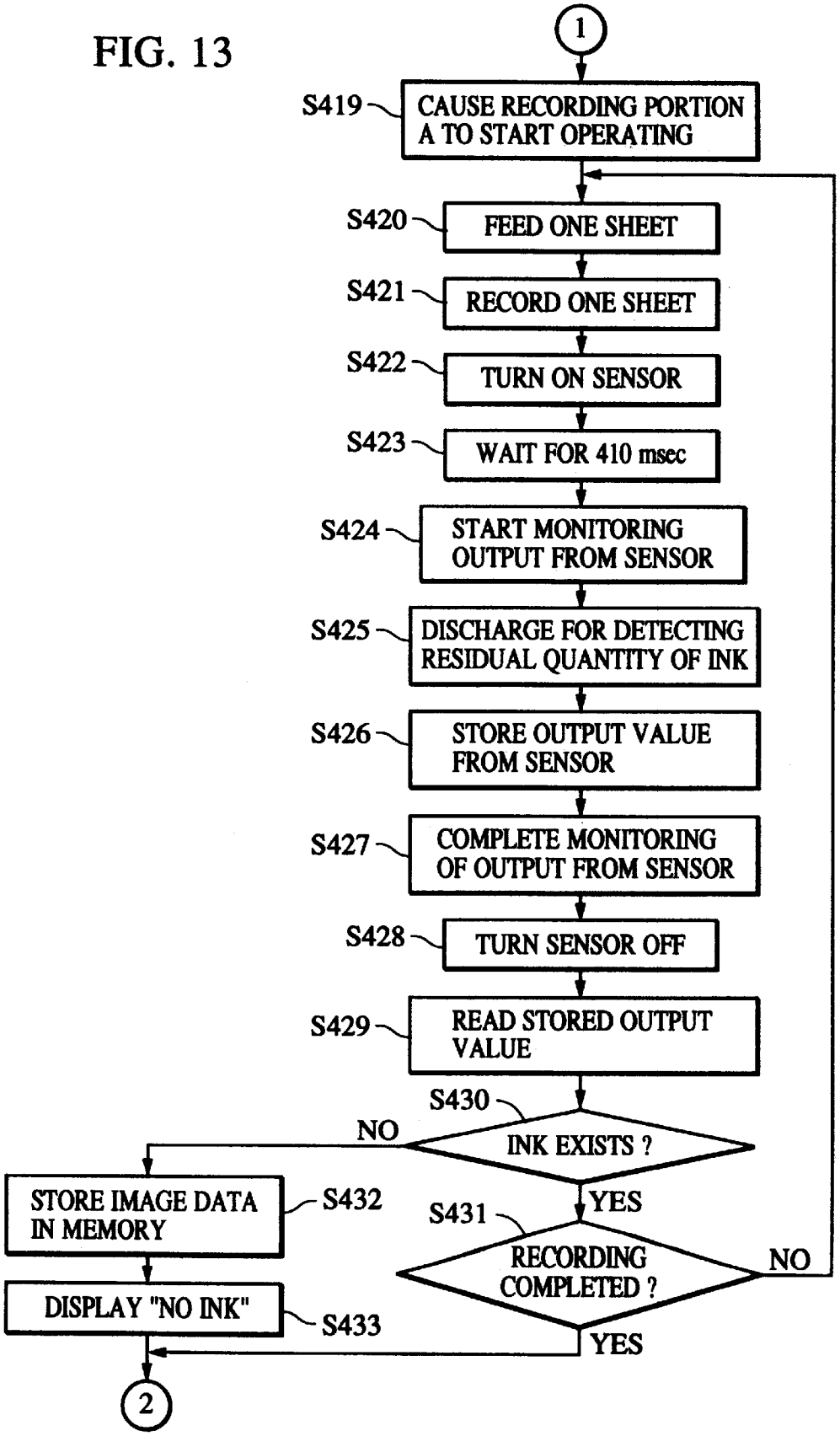
FIG. 13 is a flow chart of an operation for detecting the residual quantity of ink and malfunction of the ink detection means according to a fifth embodiment of the present invention.

Referring to FIGS. 12 and 13, a fifth embodiment of the present invention will now be described.

In step S401 image data to be recorded is received. In step S402 whether or not the recording section A can be operated normally is checked. If a determination is performed that the recording section A cannot perform the recording operation, the operation proceeds to step S413 so that an error message, such as "since recording section A cannot be operated normally, recording cannot be performed", is displayed on the LCD 259 of the operating panel 258. Then, the operation is ended here.

If a determination has been made that recording can be performed, the operation proceeds to step S403 to determine whether the switch for detecting the residual quantity of ink has been switched on. If the switch has been switched on, the operation proceeds to step S404 so that the sensor 244 for detecting the residual quantity of ink is turned on so that the light emitting device 244*a* of the sensor 244 for detecting the residual quantity of ink is caused to emit light. In step S405 waiting is performed for 410 msec from a moment the quantity of light emitted by the light emitting device 244*a* of the sensor 244 for detecting the residual quantity of ink becomes stable to a moment the output from the light receiving device 244*b* becomes stable. After the waiting has been performed, the output from the light receiving device 244*b* is monitored in step S406. In step S407 the number of pulses (CP) counted by the pulse-width counter section 284 is stored in the internal register in accordance with the foregoing output. In step S408 monitoring of the output from the light receiving device 244*b* is interrupted. In step S409 the sensor 244 for detecting the residual quantity of ink is turned off so that light emission from the light emitting device 244*a* is interrupted.

In step S410 the CPU 225 reads the sensor output value (the number of counted pulses (CP)) stored in the internal register of the pulse-width counter section 284. If the slit of the light emitting device 244*a* or the light receiving device 244*b* is plugged, or a solid body formed from ink accumulated in the ink reservoir due to deposition and lamination always shields the optical axis between the light emitting device 244*a* and light receiving device 244*b*, light is interrupted during the full time for which the light emitting device 244*a* emits light. Therefore, it can be expected that the number of counted pulses (CP) is larger than a threshold (CPO) for use in a usual detection of the residual quantity of ink although the ink discharge operation is not performed.

Therefore, in step S411 the number of the counted pulses and the threshold are compared to examine whether or not an interruption object exists on the optical axis. If CP>CP0, a determination is made that a interruption object exists on the optical axis. Thus, the operation proceeds to step S412 so that a message such as "the sensor for detecting the residual quantity of ink cannot be operated normally and checking is required" is displayed on the LCD 259 of the operation panel 258, to alert the user of the apparatus to perform an appropriate operation. Then, the process is ended here. If CP≦CP0, a determination is made that no light-interrupting object exists on the optical axis. Then, the operation proceeds to step S419.

If the operator does not switch on the switch for detecting the residual quantity of ink in order to reduce ink consumption in detection of the residual quantity of ink, the switch for detecting the residual quantity of ink will be determined to be off in step S403. Since setting is performed to interrupt the detection of the residual quantity of ink, the operation proceeds to step S414, so that the recording section A concerning the recording operation in accordance with image information is turned on to turn on the soft power. In step S416 one recording sheet is supplied. In step S416 data is recorded on the supplied recording sheet. In step S417 it is examined whether all of the recording operations have been completed. If a determination has been made that all of the recording operations have not been completed, the operation returns to step S415 so that the recording operation is repeated. If a determination has been made that all of the recording operations have been completed, the operation is ended here.

In steps S419 to S421 the operation of the recording section A concerning recording in accordance with image information is started similar to steps S414 to S416 so that soft power is turned on. Then, one recording sheet is supplied and data is recorded on the supplied sheet. After recording has been completed, the sensor 244 for detecting the residual quantity of ink is turned on in step S422, similar to steps S404 to S406, so that the light emitting device 244*a* is caused to emit light. Then, in step S423, waiting is performed for 410 msec from a moment the quantity of light emitted by the light emitting device 244*a* becomes stable to a moment the output from the light receiving device 244*b* becomes stable. Then, in step S424, the output from the light receiving device 244*b* is monitored. In step S425 ink is discharged in a predetermined quantity to interrupt the optical axis of the sensor 244 for detecting the residual quantity of ink. In this embodiment, 40 ink discharge operations from all nozzles are performed in the case of the monochrome recording head having 128 nozzles. This mode of ink discharge is only illustrative and may be modified such that, for example, 40 ink discharge operations are performed by each of odd-number nozzles out of the 128 nozzles. Such a modified ink discharge mode effectively reduces the amount of ink consumed for the purpose of detection of residual ink quantity.

In steps S426 to S429 the number of pulses (CP) counted by the pulse-width counter section 284 is stored in the internal register in accordance with the output from the light receiving device 244*b* similar to steps S407 to S410. Then, monitoring of the output from the light receiving device 244*b* is interrupted, and the sensor 244 for detecting the residual quantity of ink is turned off so that light emission from the light emitting device 244*a* is interrupted. Then, the output value (the number of counted pulses (CP)) from the sensor stored in the internal register of the pulse-width counter section 284 is read by the CPU 225.

In step S430 the number of counted pulses (CP) and the threshold (CP0) are compared to examine whether or not ink exists. If CP>CP0, a determination is made that ink exists. Then, the operation proceeds to step S431 so that a determination is made whether or not all of the recording operations have been completed. If it is determined that recording has not been completed, the operation returns to step S420 so that the recording operation is repeated. If a determination is made that all of the recording operations have been completed, the operation is ended.

If CP≦CP0, a determination is made that ink is not left, and the operation proceeds to step S432; at this point there is a risk that the image is not recorded on the recording sheet. Thus, image data is stored in the memory. In step S433 a message such as "ink is not left" is displayed on the LCD 259 of the operating panel 258 to urge the user of the apparatus to change the carriage. Then, the operation is ended.

As described above, according to the foregoing embodiments, in accordance with the output from the sensor for detecting the residual quantity of ink, a fact that contamination of the light emitting device and the light receiving device and plugging of the slit due to ink mist generated during a usual recording operation and interruption of the optical axis of the sensor due to deposited solids have resulted in the detection of the residual quantity of ink being made impossible can be determined. Moreover, this result can be signaled to the user of the apparatus. As a result, the user of the apparatus is able to detect a malfunction of the sensor for detecting the residual quantity of ink due to contamination or the like of the sensor. Thus, the user of the apparatus is able to quickly recover the operation of the sensor for detecting the residual quantity of ink by removing the mist allowed to adhere to the slit or any deposited solid body of ink. If necessary, the user may change the sensor to restore the normal state of the sensor.

Checking of the sensor for detecting the residual quantity of ink, serving as the ink detection means, is performed before any recording operation is performed, that is, in a state where soft power is turned off, in accordance with image information, such as transference of image data, operation of changing the resolution of received image data, and the actual recording operation. Therefore, checking of the sensor for detecting the residual quantity of ink is not performed during the recording operation. Thus, the central processing unit (CPU) is able to perform operations concerning recording while being freed from checking of the sensor for detecting residual quantity of ink. Therefore, the time required to perform recording can be shortened and the recording throughput can be improved.

Although the structure comprising the photointerrupter-type ink discharge detection apparatus has been described in each of the foregoing embodiments, the present invention is not limited to the foregoing structure. The present invention may also be applied to an apparatus comprising the aforementioned reflecting-type photosensor to detect a mark recorded on the recording medium so as to detect a defect in ink discharge. The reflecting-type photosensor detects a defect in ink discharge in such a manner that the intensity of light reflected from a white portion on the recording sheet is made to be output High and light reflected from a black portion of the ink of the mark is made to be output Low.

That is, by forming the opposite portion of the reflecting-type photosensor by a white member, the reflecting-type photosensor serving as the ink detection sensor is operated in place of the light emission from the light emitting device to measure the intensity of light reflected by the opposite member. If the value is smaller than a threshold, the output from the photosensor is low although no mark is recorded. Therefore, occurrence of malfunction such as adhesion of foreign matter to the photosensor can be detected and, therefore, the user may be alerted to the problem.

The recording apparatus according to the present invention may be in the form of a copying apparatus combined with a reader or the like, or a facsimile apparatus having a transmission/receiving function as well as an integrated or independent apparatus serving as image output terminal equipment of information processing apparatus such as a word processor or computer.

Figure 14:
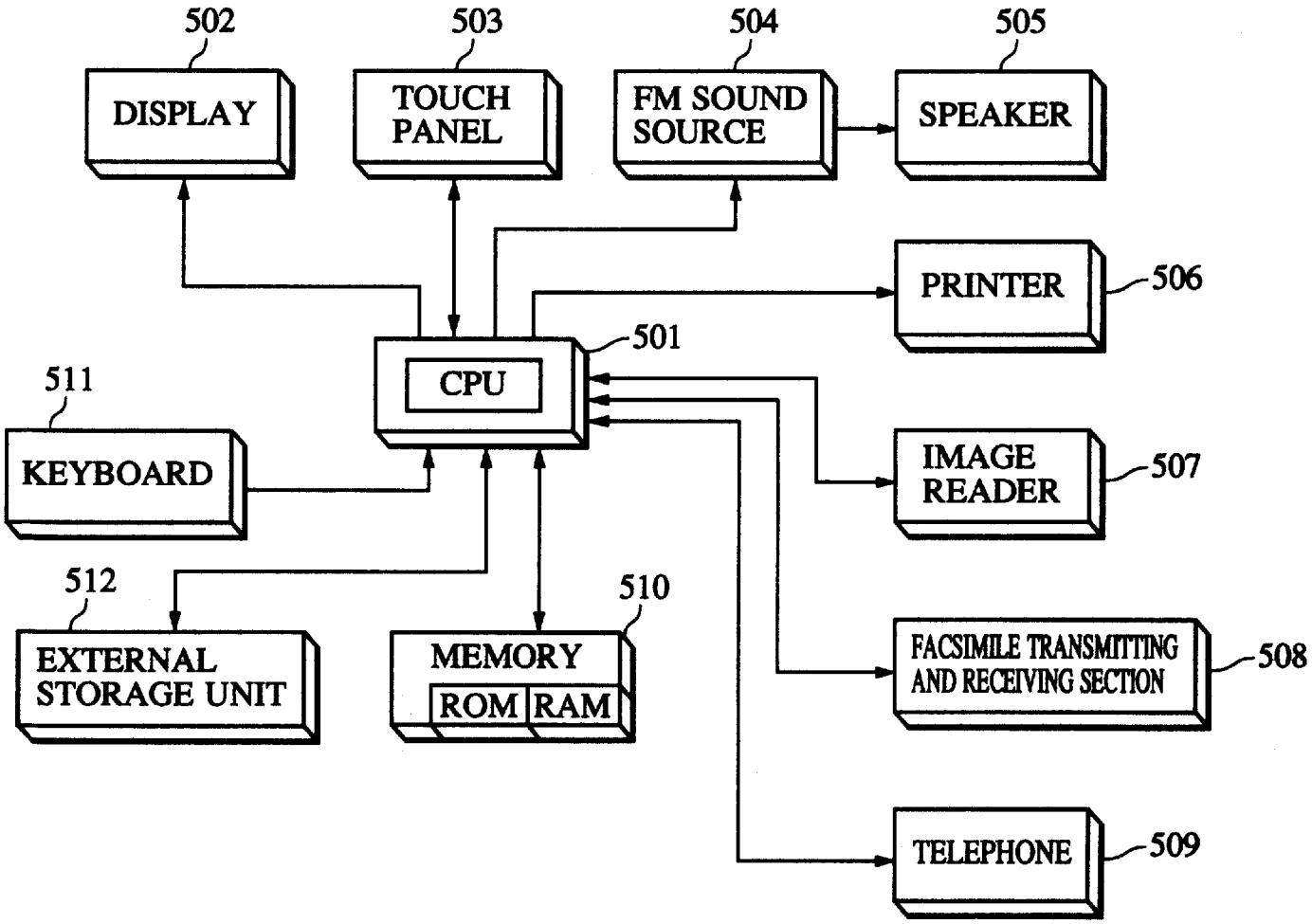
FIG. 14 is a block diagram of the schematic structure of a case where the recording apparatus according to the present invention is applied to an information processing apparatus.

FIG. 14 is a block diagram showing the schematic structure of a case wherein the recording apparatus according to the present invention is applied to an information processing apparatus having functions such as a word processor, personal computer, facsimile apparatus and a copying machine.

Referring to FIG. 14, reference numeral 501 represents a control section for overall control of the apparatus, the control section 501 having a CPU, such as a microprocessor and various I/O ports so as to transmit control signals and data signals to respective sections and receive control signals and data signals from respective sections to control the apparatus. Reference numeral 502 represents a display section on which various menus, document information and image data read by an image reader 507. Reference numeral 503 represents a pressure-sensitive transparent touch panel disposed on the display section 502 and having a surface arranged to be depressed by a user's finger or the like to input items and coordinates on the display section 502.

Reference numeral 504 represents an FM (Frequency Modulation) sound source section for causing music information produced by a music editor or the like to be stored in a memory section 510 or a external storage unit 512 as digital data and reading the same from these memories to perform FM-modulation. An electric signal transmitted from the FM sound source section 504 is converted into an audible sound through a speaker section 505. A printer section 506 is an output terminal of a word processor, a personal computer, a facsimile apparatus or a copying machine to which the recording apparatus according to the present invention is applied.

Reference numeral 507 represents an image reader section for photoelectrically reading data of an original document to input the same, the image reader 507 being disposed at an intermediate position on the conveyance passage for the original document so as to read a facsimile original document, original document to be copied and another original document. Reference numeral 508 represents a facsimile transmitting/receiving section for facsimile-transmitting data of the original document read by the image reader 507 and receiving and decoding a transmitted facsimile signal, the facsimile transmitting/receiving section 508 having an interface function with the outside. Reference numeral 509 represents a telephone section having various telephone functions, such as a general telephone function and an auto-answering telephone.

Reference numeral 510 represents a memory section including a ROM for storing a system program, a manager program, application programs, fonts and dictionaries, a RAM for storing application programs and character information loaded from the external storage unit 512, a video RAM and the like.

Reference numeral 511 represents a keyboard section for inputting document information and various commands. Reference numeral 512 represents the external storage unit comprising a floppy disk or a hard disk as the recording medium thereof. The external storage unit 512 stores character information, music or voice information and user application programs.

Figure 15:
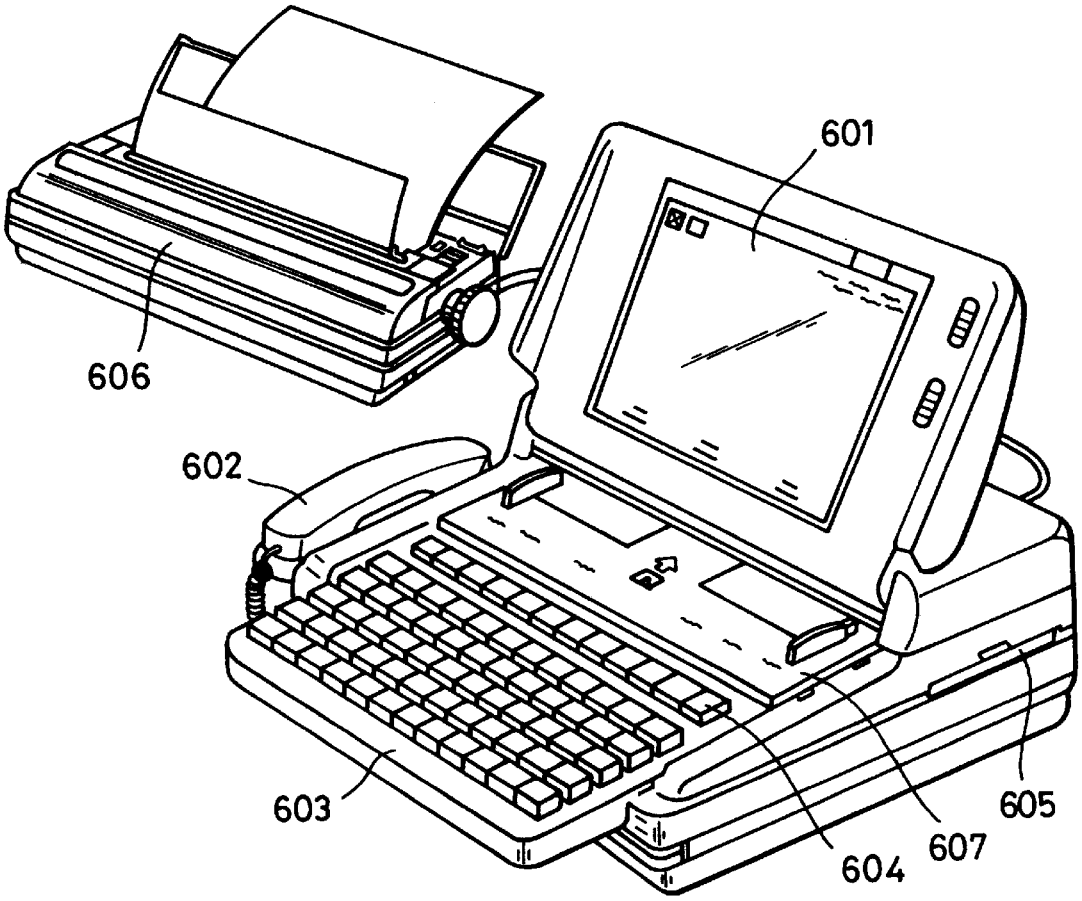
FIG. 15 is a schematic view of the information processing apparatus.

FIG. 15 is a perspective view of the information processing apparatus shown in FIG. 14. Referring to FIG. 15, reference numeral 601 represents a flat panel display unit comprising liquid crystal device or the like to display various menus, graphic information and document information. A touch panel is disposed on the flat panel display unit 601 so that when the surface of the touch panel is depressed by a user's finger or the like, coordinates and items to be instructed are input. Reference numeral 602 represents a handset for use when the apparatus is used as a telephone set.

The keyboard 603 is detachably connected to the body of the apparatus through a cable to input various character information and data. The keyboard 603 has various function keys 604. Reference numeral 605 represents a floppy-disk insertion port.

Reference numeral 607 represents a paper stacking section for receiving an original document to be read by the image reader section, the read original document being discharged from the rear portion of the apparatus. When facsimile data is received, data is recorded by an ink jet printer 606.

Although the flat panel display unit 601 may comprise a CRT, it is preferable that a flat panel comprising a liquid crystal display unit with a ferroelectric liquid crystal be used. The reason for this is that the size, thickness and weight can be reduced. Referring to FIG. 14, a case where the foregoing information processing apparatus acts as a word processor will now be described. Character information input through the keyboard section 511 is processed in accordance with a document processing program in the control section 501 so as to be transmitted to the printer section 506 as an image.

When the information processing apparatus described above functions as a personal computer, various data entered through the keyboard section are processed by the control section 501 in accordance with an application program, and the computation results are delivered to the printer section 506 so as to be displayed as an image.

In the case where the apparatus acts as a facsimile receiver, facsimile information input through the facsimile transmitting/receiving section 508 through the communication line is processed by the control section 501 in accordance with a predetermined reception program so as to be transmitted to the printer section 506 as a received image.

In the case where the apparatus acts as a copying machine, the image reader 507 reads an original document. The read data of the original document is transmitted to the printer section 506 through the control section 501 as an image to be copied. In a case where the apparatus acts as a transmitter of the facsimile apparatus, data of the original document read by the image reader 507 is processed by the control section 501 in accordance with a predetermined transmission program, and then transmitted to the communication line through the facsimile transmitting/receiving section 508.

Figure 16:
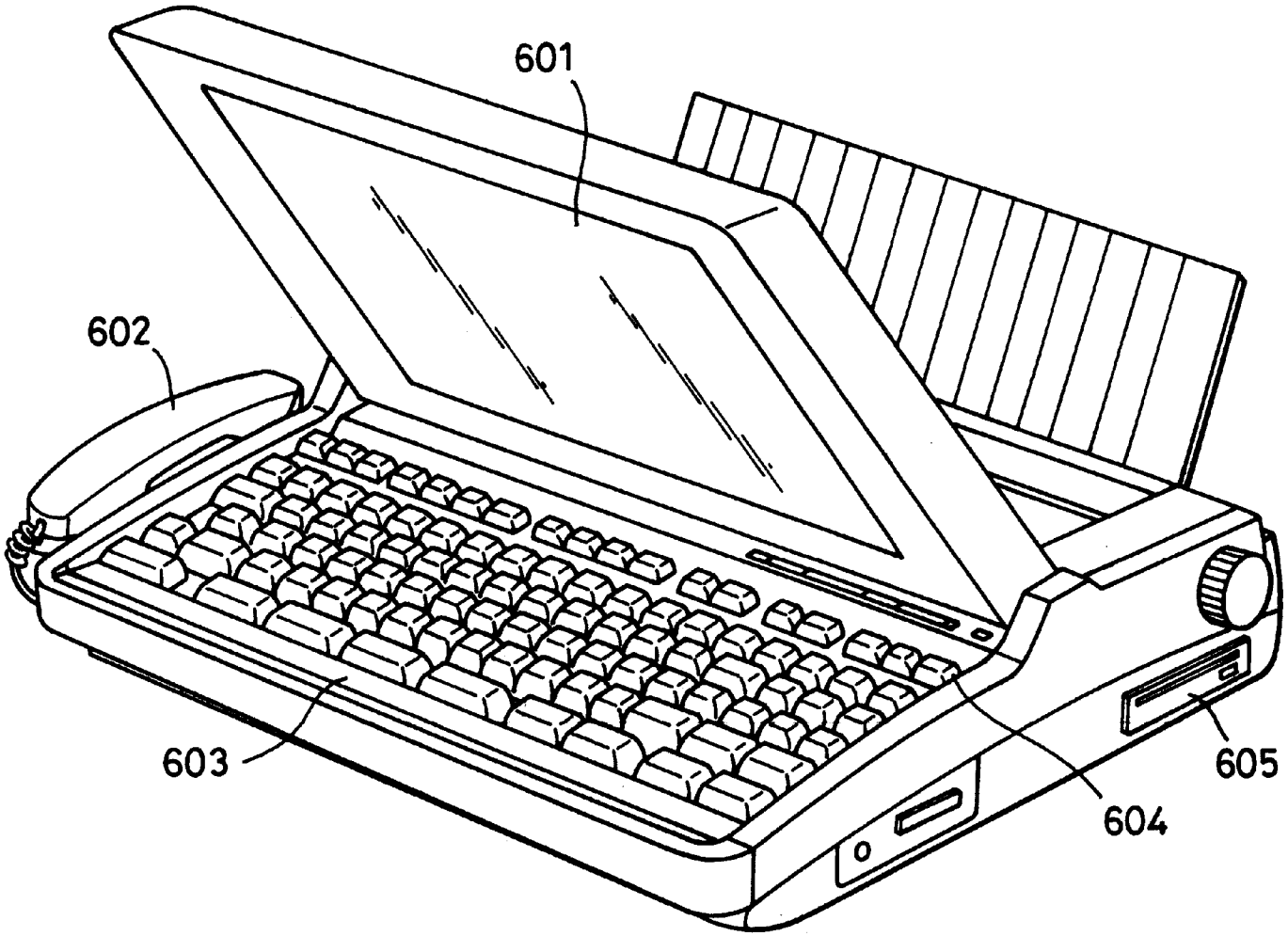
FIG. 16 is a schematic view of another information processing apparatus.

Note that the foregoing information processing apparatus may be formed into an integrated structure including an ink jet printer in the body thereof, as shown in FIG. 16. In the foregoing case, satisfactory portability can be realized. Referring to FIG. 16, elements having the same functions are given the same reference numerals.

By applying the recording apparatus according to the present invention to the foregoing multi-function information processing apparatus, a high-grade recorded image can be formed. Therefore, the function of the foregoing information processing apparatus can further be improved.

The present invention may be adapted to a system comprising a plurality of apparatuses or just one apparatus. The present invention may, of course, be adapted to the case where a program for executing the present invention is supplied. In the foregoing case, a recording medium storing a program relating to the present invention constitute the present invention. By reading the program from the recording medium into the system or the apparatus, the system or the apparatus is operated in a predetermined manner.

Although the foregoing embodiment comprises a switch for detecting the residual quantity of ink, the present invention is not limited to this. For example, service personal for the apparatus or a soft switch set by a user of the apparatus may be employed.

As described above, according to the present invention, the recording apparatus is provided with a determination means for determining a malfunction of the ink detection means so that an erroneous detection occurring due to malfunction of the ink detection means is prevented. Thus, a reliable recording apparatus can be obtained.

Although the invention has been described in its preferred form with a certain degree of particularity, it is understood that the present disclosure of the preferred form can be changed in the details of its construction and in the combination and arrangement of parts without departing from the spirit and the scope of the invention as hereinafter claimed.

What is claimed is:

1. A recording apparatus having a recording head for discharging ink to record data on a recording medium, said recording apparatus comprising:

ink detection means for performing an ink detection operation to detect discharge of ink from said recording head, said ink detection means generating an output indicating whether or not ink is being discharged from said recording head;

control means having a non-discharge ink detection state for causing said ink detection means to perform the ink detection operation for at least part of a time while an ink discharge operation is not being performed from said recording head; and determination means for determining that a malfunction of said ink detection means has occurred, wherein said determination means determines that the malfunction has occurred in a case that the output of said ink detection means indicates that ink is being discharged from said recording head and said control means is in the non-discharge ink detection state.

2. A recording apparatus according to claim 1, wherein said control means operates said ink detection means in a predetermined case.

3. A recording apparatus according to claim 2, wherein said predetermined case is where a predetermined time has passed from input of a power source for said recording apparatus.

4. A recording apparatus according to claim 2, wherein said control means further comprises means for detecting a mounting of said recording head on a body of said apparatus, and said predetermined case is where said control means has detected the mounting of said recording head on the body of said apparatus.

5. A recording apparatus according to claim 2, wherein said predetermined case occurs before an operation of detecting a residual quantity of ink by using said ink detection means.

6. A recording apparatus according to claim 1, further comprising indicating means for indicating that said determination means has determined that said ink detection means has malfunctioned.

7. A recording apparatus according to claim 1, wherein said ink detection means includes a light emitting device, a light receiving device for receiving light emitted by said light emitting device and comparison means for comparing an output from said light receiving device with a predetermined threshold.

8. A recording apparatus according to claim 7, wherein said determination means determines whether said ink detection means is being operated normally in accordance with an output of said comparison means denoting a result of a comparison performed by said comparison means.

9. A recording apparatus according to claim 8, wherein said light emitting device is a light emitting diode, and said light receiving device is a phototransistor.

10. A recording apparatus according to claim 6, wherein said indicating means includes a display means for displaying a message.

11. A recording apparatus according to claim 1, further comprising instruction means for issuing an instruction to determine whether a malfunction has occurred in said ink detection means.

12. A recording apparatus according to claim 11, wherein said control means further comprises means for controlling said ink detection means to perform detection of ink at a predetermined interval or a predetermined timing in accordance with the instruction issued by said instruction means and a result of a determination performed by said determination means.

13. A recording apparatus according to claim 12, wherein said predetermined timing includes a time at which recording of a page of said recording medium has been completed.

14. A recording apparatus according to claim 12, further comprising recording control means for interrupting a recording operation of said recording head to store data to be recorded in said recording operation when said ink detection means detects that no ink is discharged from said recording head.

15. A recording apparatus according to claim 1, wherein said recording head discharges a plurality of colors to perform color recording, and ink discharge conditions and determination conditions for said ink detection means and said determination means are set for each of said plurality of colors.

16. A recording apparatus according to claim 11, wherein operations of said ink detection means and said determination means are simultaneously changed in accordance with an instruction issued by said instruction means.

17. A recording apparatus according to claim 1, wherein said control means operates said ink detection means prior to performing a recording operation in accordance with image information.

18. A recording apparatus according to claim 1, wherein said control means operates said ink detection means when said control means does not perform a recording operation in accordance with image information.

19. A recording apparatus according to claim 1, wherein said recording head is an ink jet recording head.

20. A recording apparatus according to claim 19, wherein said ink jet recording head uses heat energy to discharge ink.

21. A recording apparatus according to claim 1, wherein said recording apparatus has a structure for use as a facsimile apparatus.

22. A recording apparatus according to claim 1, wherein said recording apparatus has a structure for recording data transmitted from a computer.

23. A recording apparatus according to claim 1, wherein said recording apparatus has a structure for use as a copying apparatus.

24. A recording apparatus according to claim 2, wherein said control means further comprises means for detecting a mounting of an ink tank for supplying ink to said recording head on a body of said apparatus, and said predetermined case is where said control means has detected the mounting of said ink tank on the body of said apparatus.

25. A method of detecting a malfunction of an ink detection means for performing an ink detection operation to detect discharge of ink from a recording head for performing recording by discharging ink, the ink detection means generating an output indicating whether or not ink is being discharged from said recording head, said method comprising the steps of:

operating said ink detection means in a non-discharge ink detection state for causing said ink detection means to perform the ink detection operation for at least part of a time while an ink discharge operation is not being performed from said recording head; and determining that a malfunction of said ink detection means has occurred in a case that the output of said ink detection means indicates that ink is being discharged from said recording head and said ink detection means is operating in the non-discharge ink detection state.

26. A method of detecting a malfunction of an ink detection means according to claim 25, wherein said ink detection means is operated at a predetermined timing.

27. A method of detecting a malfunction of an ink detection means according to claim 25, further comprising a step of indicating the malfunction of said ink detection means.

28. A method of detecting a malfunction of an ink detection means according to claim 25, wherein said recording head is an ink jet recording head.

29. A method of detecting a malfunction of an ink detection means according to claim 26, wherein said ink jet recording head discharges ink by using heat energy.

* * * * *

UNITED STATES PATENT AND TRADEMARK OFFICE

CERTIFICATE OF CORRECTION

PATENT NO. : 5,963,225

DATED : October 5, 1999

INVENTOR(S) : Shigeyuki Sugiyama

It is certified that error appears in the above-identified patent and that said Letters Patent is hereby corrected as shown below:

COLUMN 12:

Line 51, "Sill" should read --S111--.

COLUMN 24:

Line 10, "claim 26," should read --claim 28,--.

Signed and Sealed this

Twenty-seventh Day of June, 2000

*Attest:*

Q. TODD DICKINSON

*Attesting Officer*

*Director of Patents and Trademarks*